US011810737B2

(12) United States Patent
Yasuda

(10) Patent No.: US 11,810,737 B2
(45) Date of Patent: Nov. 7, 2023

(54) SWITCH DEVICE AND TIMEPIECE

(71) Applicant: CASIO COMPUTER CO., LTD., Tokyo (JP)

(72) Inventor: Takumi Yasuda, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 209 days.

(21) Appl. No.: 17/376,384

(22) Filed: Jul. 15, 2021

(65) Prior Publication Data

US 2022/0028633 A1 Jan. 27, 2022

(30) Foreign Application Priority Data

Jul. 27, 2020 (JP) ..... 2020-126302
Jul. 27, 2020 (JP) ..... 2020-126306

(51) Int. Cl.

| | |
|---|---|
| ***H01H 19/14*** | (2006.01) |
| ***H01H 19/08*** | (2006.01) |
| ***G04G 17/08*** | (2006.01) |
| ***G04G 21/08*** | (2010.01) |

(52) U.S. Cl.

CPC ..... *H01H 19/14* (2013.01); *G04G 17/08* (2013.01); *G04G 21/08* (2013.01); *H01H 19/08* (2013.01)

(58) Field of Classification Search

CPC .. H01H 19/08; H01H 19/14; H01H 2221/062; H01H 3/60; H01H 13/06; G04G 17/02; G04G 17/08; G04G 21/08

See application file for complete search history.

(56) References Cited

U.S. PATENT DOCUMENTS

| | | | | |
|---|---|---|---|---|
| 8,419,269 | B2 | 4/2013 | Hiranuma | |
| 8,911,143 | B2 | 12/2014 | Kitahara et al. | |
| 10,627,781 | B2 | 4/2020 | Ichimura et al. | |
| 11,150,610 | B2 * | 10/2021 | Yasuda | G04C 3/001 |
| 11,181,867 | B2 | 11/2021 | Hitsumoto | |
| 2009/0147630 | A1 * | 6/2009 | Clerc | G04B 37/106 368/290 |
| 2016/0093453 | A1 * | 3/2016 | Sakurazawa | H01H 13/14 368/321 |

FOREIGN PATENT DOCUMENTS

| | | |
|---|---|---|
| CN | 102200753 A | 9/2011 |
| CN | 103676599 A | 3/2014 |

(Continued)

OTHER PUBLICATIONS

Japanese Office Action (and English language translation thereof) dated Apr. 25, 2022, issued in counterpart Japanese Application No. 2020-126302.

(Continued)

*Primary Examiner* — Edwin A. Leon
(74) *Attorney, Agent, or Firm* — Holtz, Holtz & Volek PC

(57) ABSTRACT

A switch device includes: a case provided with a through-hole; an operation member having an operation shaft to be inserted into the through-hole of the case, and an operation head provided at an outer end of the operation shaft; and a protective buffer member which has elasticity and is attached to an outer surface of the case. The protective buffer member includes a storage which has a bottom facing an inner end surface of the operation head and stores a periphery of the operation head.

42 Claims, 8 Drawing Sheets

(56) References Cited

FOREIGN PATENT DOCUMENTS

| | | | |
|---|---|---|---|
| CN | 205899263 | U | 1/2017 |
| CN | 108666157 | A | 10/2018 |
| CN | 110993407 | A | 4/2020 |
| CN | 210776204 | U | 6/2020 |
| JP | 2000329869 | A | 11/2000 |
| JP | 2008096232 | A | 4/2008 |
| JP | 2017212078 | A | 11/2017 |
| JP | 2018040609 | A | 3/2018 |
| JP | 2019070655 | A | 5/2019 |
| JP | 2019219224 | A | 12/2019 |
| JP | 2020098145 | A | 6/2020 |

OTHER PUBLICATIONS

Chinese Office Action (and English language translation thereof) dated Aug. 19, 2022 issued in counterpart Chinese Application No. 202110833145.

* cited by examiner

SWITCH DEVICE AND TIMEPIECE

BACKGROUND

Technical Field

The technical field relates to a switch device used in electronic devices such as a wristwatch and to a timepiece including the same.

Description of the Related Art

There is known a switch device for a wristwatch configured such that a pipe is fitted into a through-hole of a case body, an operation shaft of an operation member is slidably inserted into the pipe, and an operation head of the operation member protrudes to the outside of the case body, and the protruding operation head is protected by an exterior member, as described in JP 2000-329869 A.

SUMMARY

An aspect of the present invention is a switch device that includes: a case provided with a through-hole; an operation member having an operation shaft to be inserted into the through-hole of the case, and an operation head provided at an outer end of the operation shaft; and a protective buffer member which has elasticity and is attached to an outer surface of the case. The protective buffer member includes a storage which has a bottom facing an inner end surface of the operation head and stores a periphery of the operation head.

DESCRIPTION OF THE EMBODIMENT

Hereinafter, an embodiment of a wristwatch will be described with reference to FIGS. 1 to 9.

Figure 1:
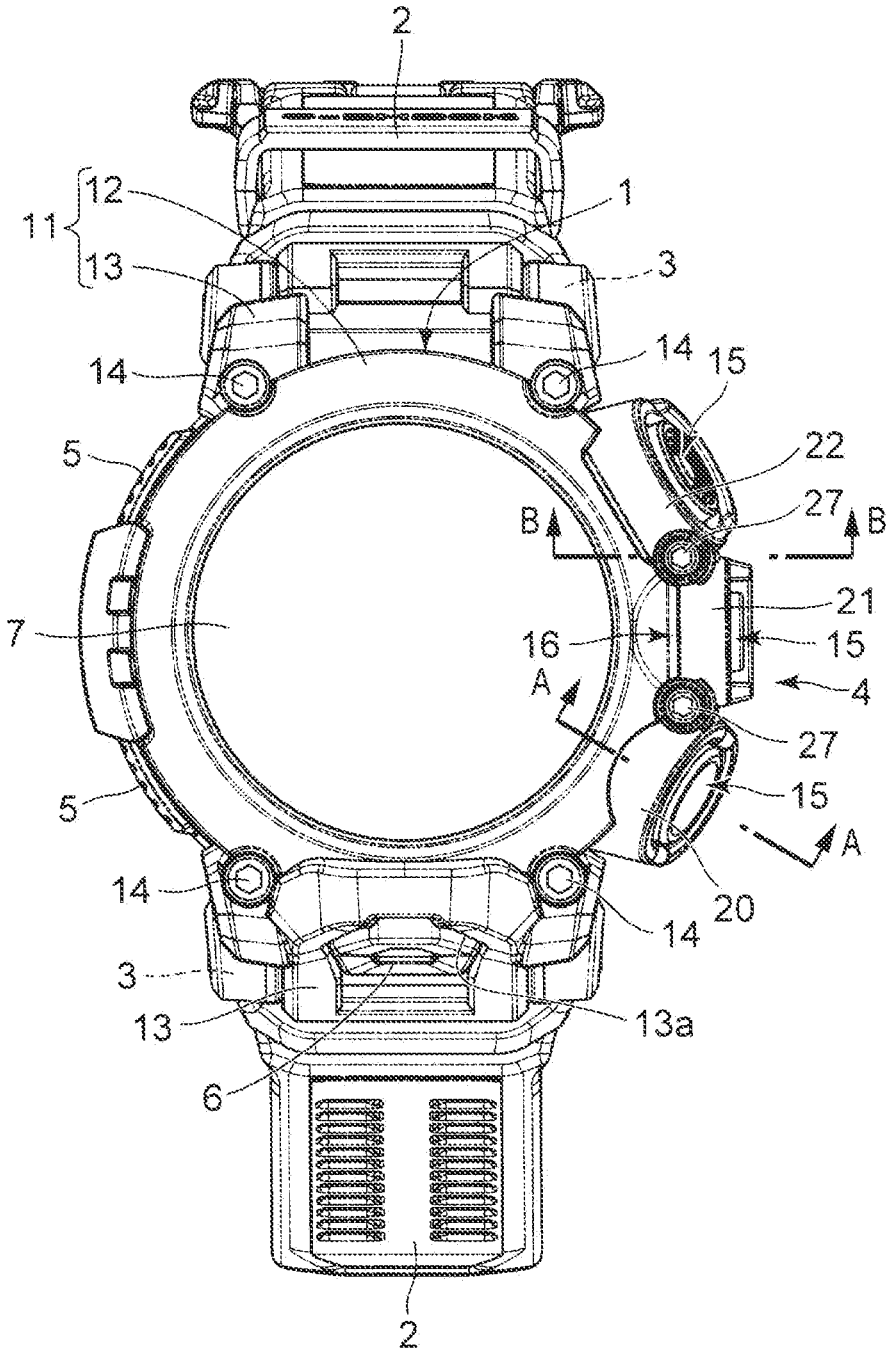
FIG. 1 is an enlarged front view illustrating an embodiment of the wristwatch.
Figure 2:
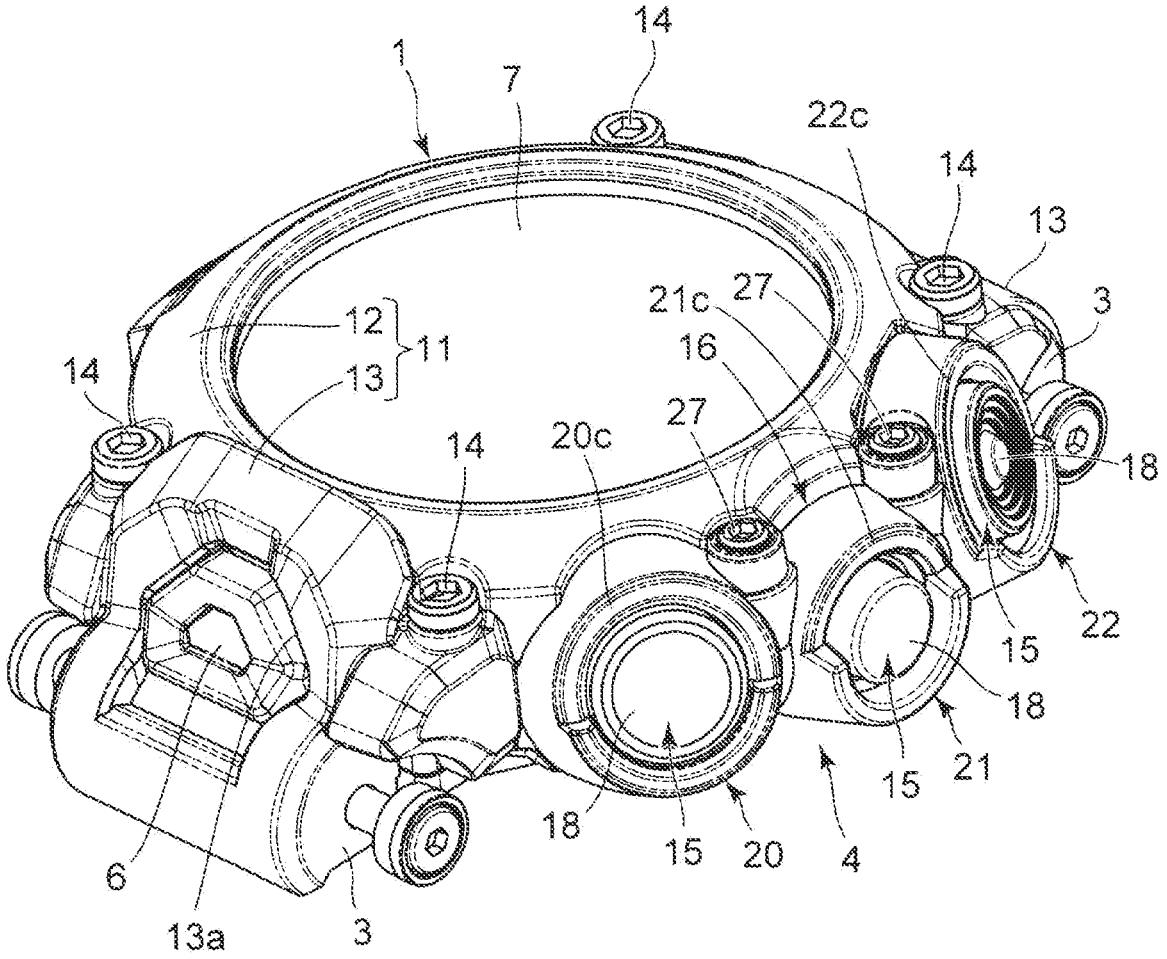
FIG. 2 is an exploded perspective view of the wristwatch illustrated in FIG. 1.

The wristwatch includes a wristwatch case 1 as illustrated in FIGS. 1 and 2. Band attachment portions 3, which will be described later, to which a watch band 2 is to be attached are provided on the 12 o'clock side and the 6 o'clock side, respectively, of the wristwatch case 1.

Figure 3:
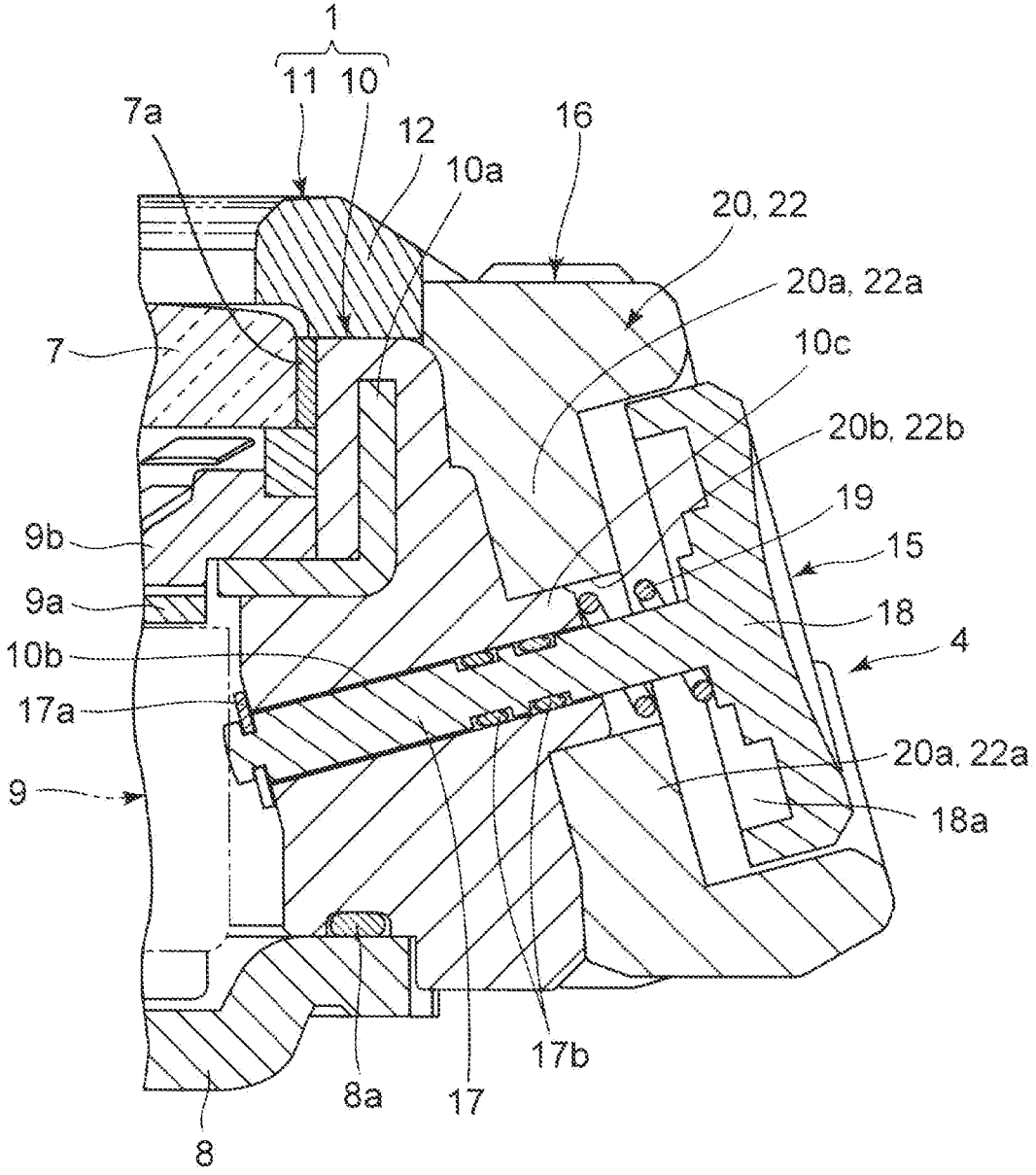
FIG. 3 is an enlarged cross-sectional view illustrating main parts of the wristwatch illustrated in FIG. 1 in view A-A.

As illustrated in FIGS. 1 and 2, a switch device 4 is provided from the 2 o'clock side to the 4 o'clock side of the wristwatch case 1, and pushbutton switches 5 are provided on the 8 o'clock side and the 10 o'clock side, respectively, of the wristwatch case 1. In addition, an upper surface switch 6 is provided on the 6 o'clock side of the wristwatch case 1. A timepiece glass 7 is provided in an upper opening of the wristwatch case 1 via a glass gasket 7*a*, as illustrated in FIG. 3. A back lid 8 is attached to a lower portion of the wristwatch case 1 via a waterproof gasket 8*a*.

Inside the wristwatch case 1, a timepiece module 9 is provided as illustrated in FIG. 3. Although not illustrated, the timepiece module 9 includes various parts necessary for a timepiece function, such as a timepiece movement indicating time by moving a pointer, a display unit that electro-optically displays information, such as time, and a circuit unit that electrically controls and drives the timepiece movement and the display unit. In this case, a dial face 9*a* is disposed on an upper surface of the timepiece module 9, and a parting member 9*b* is provided on an outer peripheral portion of the upper surface of the dial face 9*a*, as illustrated in FIG. 3.

Meanwhile, the wristwatch case 1 includes a case body 10 and an exterior member 11 as illustrated in FIGS. 1 to 3. The case body 10 is made of a highly rigid polyamide resin containing carbon fibers or glass fibers, and is light in weight and high in strength. A metal reinforcing member 10*a* is embedded in the case body 10.

Figure 6:
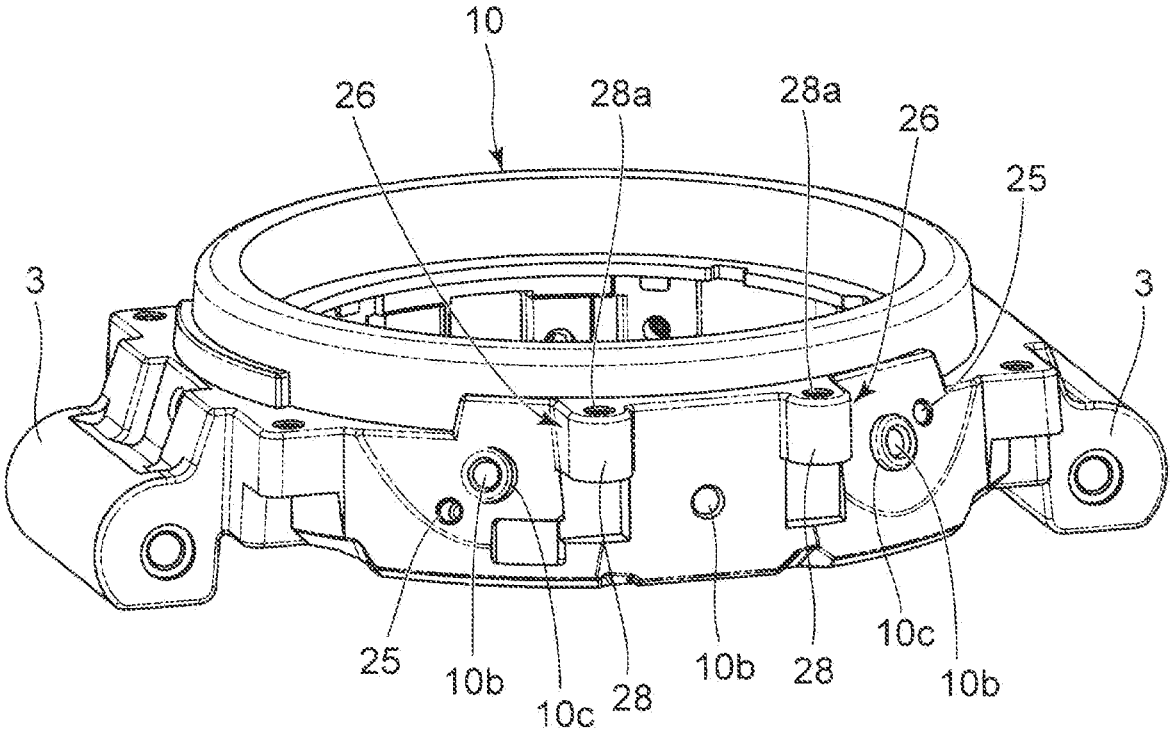
FIG. 6 is an enlarged perspective view illustrating the case body illustrated in FIG. 5.

As illustrated in FIG. 6, the band attachment portions 3 are provided on the 12 o'clock side and the 6 o'clock side, respectively, of the case body 10. As illustrated in FIGS. 1 and 2, the exterior member 11 includes a first cover 12 disposed on an upper portion of the case body 10 so as to cover the case body 10, and two second covers 13 disposed on the 12 o'clock side and the 6 o'clock side of the case body 10 so as to cover the band attachment portions 3.

As illustrated in FIGS. 1 and 2, the first cover 12 is formed in a substantially ring shape by metal such as stainless steel and titanium. The two second covers 13 are made of a soft synthetic resin such as a urethane resin. In this case, the second cover 13 on the 6 o'clock side is provided with a switch opening 13*a* configured to expose the upper surface switch 6. The first cover 12 and the second cover 13 are attached to the band attachment portions 3 of the case body 10 on the 12 o'clock side and the 6 o'clock side by a plurality of first screw members 14.

On the other hand, the switch device 4 includes three pushbutton switches and is provided from the 2 o'clock side to the 4 o'clock side, as illustrated in FIGS. 1 to 3. That is, the switch device 4 includes: three operation members 15 each of which is provided on the 2 o'clock side, the 3 o'clock side, and the 4 o'clock side of the case body 10; and one protective buffer member 16 provided on an outer surface of the case body 10 from the 2 o'clock side to the 4 o'clock side to protect the three operation members 15.

As illustrated in FIGS. 3 and 6, each of the three operation members 15 includes: an operation shaft 17 to be inserted into each of three through-holes 10*b* provided on the 2 o'clock side, the 3 o'clock side, and the 4 o'clock side in the case body 10; an operation head 18 provided at an outer end of the operation shaft 17 and disposed outside the case body 10; and a spring member 19 that biases the operation head 18 in a direction of pushing the operation head toward the outside of the case body 10.

Figure 5:
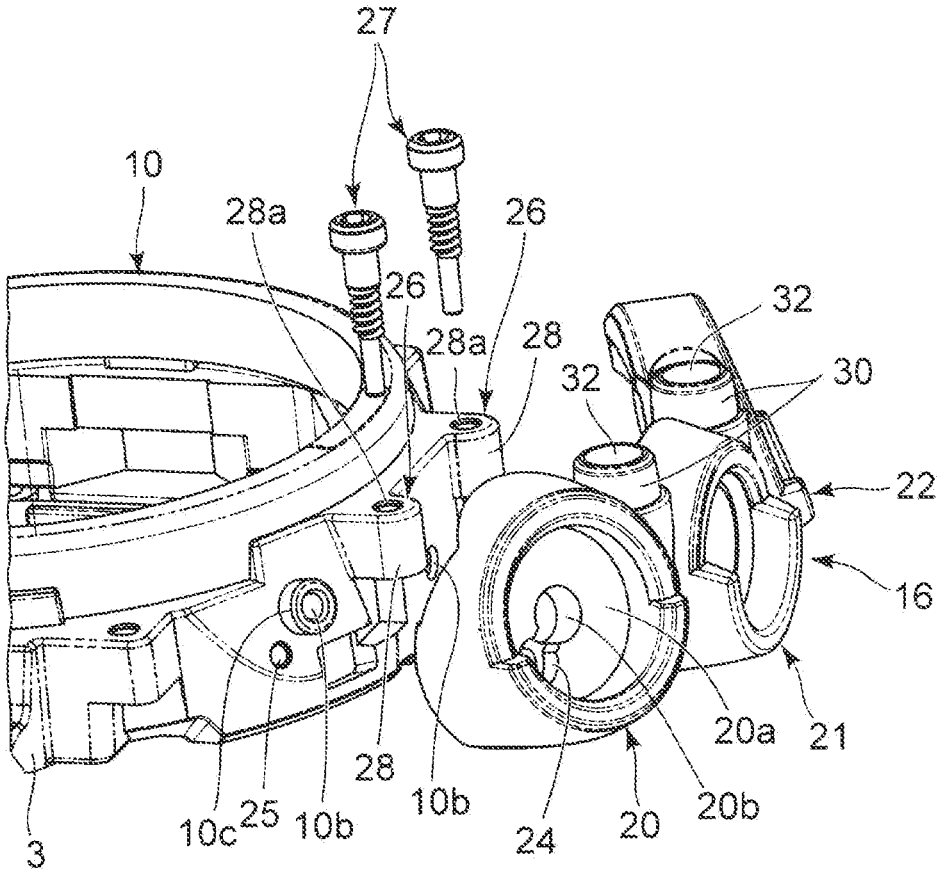
FIG. 5 is an exploded perspective view of main parts of the wristwatch illustrated in FIG. 2, which illustrates a state where a protective buffer member is attached to a case body in an enlarged manner.

In this case, as illustrated in FIGS. 3, 5, and 6, cylindrical guide protrusions 10*c* protruding outward are provided for the through-holes 10*b* on the 2 o'clock side and the 4 o'clock side of the case body 10 so as to correspond to each other on the same axis, on outer peripheral surfaces of the case body 10 corresponding to the operation members 15 on the 2 o'clock side and the 4 o'clock side, respectively. In addition, each of the operation shaft 17 of the operation member 15 has an outer diameter substantially equal to an inner diameter of the through-hole 10*b* of the case body 10. The operation shaft 17 has an axial length longer than a length of the through-hole 10*b* of the case body 10.

As a result, the operation shaft 17 is configured such that an inner end thereof protrudes to the inside of the case body 10 and an outer end thereof protrudes to the outside of the case body 10 as illustrated in FIG. 3. In this case, the operation shaft 17 is configured such that a retaining member 17*a*, such as an E-ring, is attached to the inner end protruding into the case body 10, and is prevented from coming out of the case body 10 by the retaining member 17*a*.

In addition, a plurality of waterproof rings 17*b* are provided on an outer circumference of the operation shaft 17 as illustrated in FIG. 3. The plurality of waterproof rings 17*b* are configured to slide in a state where outer circumferences thereof are in elastic contact with inner peripheral surfaces of the through-hole 10*b* of the case body 10. As a result, the plurality of waterproof rings 17*b* are configured to waterproof a portion between an outer peripheral surface of the operation shaft 17 and the inner peripheral surface of the through-hole 10*b* of the case body 10.

As illustrated in FIGS. 2 and 3, the operation head 18 is formed in a substantially disk shape. The operation head 18 has a structure in which a recess 18*a* is provided on an inner end surface on the case body 10 side, and the outer end of the operation shaft 17 is integrally provided on an inner surface of the recess 18*a*. The operation head 18 is formed to have an outer diameter sufficiently larger than the outer diameter of the operation shaft 17 and have a size smaller than a size of the case body 10 in the front-back surface direction (thickness direction).

As illustrated in FIG. 3, the spring member 19 is, for example, a coil spring, and is formed to have an inner diameter larger than the outer diameter of the operation shaft 17 and an outer diameter equal to or slightly smaller than an outer diameter of the guide protrusion 10*c* of the case body 10. As a result, the spring member 19 has one end brought into elastic contact with the guide protrusion 8*b* of the case body 10 in the state of being disposed on the outer circumference of the operation shaft 17 and the other end brought into elastic contact with the inner surface of the recess 18*a* of the operation head 18 to bias the operation head 18 in a direction of being pushed out toward the outside of the case body 10.

On the other hand, the protective buffer member 16 is made of a synthetic resin having elasticity, for example, a urethane resin having high hardness as illustrated in FIGS. 1 to 5. That is, the urethane resin ranges from rank A having low hardness to rank E having high hardness. Among them, urethane resins having hardness of rank C to E rank are preferable, and a urethane resin having high hardness of rank D having a buffering property is adopted in the present embodiment.

As illustrated in FIGS. 1 to 5, the protective buffer member 16 is formed to have a large thickness as a whole, and is disposed on the outer peripheral surface of the case body 10 from the 2 o'clock side to the 4 o'clock side. The protective buffer member 16 is provided with: a first storage 20 that stores the operation head 18 of the operation member 15 on the 4 o'clock side a second storage 21 that stores the operation head 18 of the operation member 15 on the 3 o'clock side; and a third storage 22 that stores the operation head 18 of the operation member 15 on the 2 o'clock side.

Among the first to third storages 20 to 22, the first and third storages 20 and 22 on the 4 o'clock side and the 2 o'clock side are formed in substantially cylindrical recess shapes having bottoms 20*a* and 22*a*, respectively, which face an inner end surface of the operation head 18 positioned on the case body 10 side as illustrated in FIGS. 2 to 5, and FIGS. 7A and 7B. The first and third storages 20 and 22 are integrally formed with the bottoms 20*a* and 22*a*, respectively. Each of the bottoms 20*a* and 22*a* of the first and third storages 20 and 22 elastically abuts on the inner end surface of the operation head 18 to buffer an impact of the operation head 18.

That is, each of the bottoms 20*a* and 22*a* of the first and third storages 20 and 22 is configured to buffer the impact of the operation head 18 such that the impact of the operation head 18 is not transmitted to the case body 10 as illustrated in FIG. 3. In this case, each of the bottoms 20*a* and 22*a* of the first and third storages 20 and 22 is formed to have a thickness equal to or larger than a thickness of an outer peripheral wall of each of the first and third storages 20 and 22.

In addition, as illustrated in FIGS. 3 to 7A and 7B, shaft insertion holes 15*b* and 20*b* into which the operation shaft 17 of the operation member 22 is inserted are provided in the bottoms 20*a* and 22*a*, respectively, of the first and third storages 20 and 22 so as to correspond to the through-holes 10*b* of the case body 10 on the same axis. Each of the shaft insertion holes 20*b* and 22*b* of the first and third storages 20 and 22 is formed such that an inner diameter thereof is substantially equal to the outer diameter of the guide protrusion 10*c* of the case body 10 and is larger than the inner diameter of the through-hole 10*b*, and an axial length is about two times longer than a length of the guide protrusion 10*c*.

As a result, as illustrated in FIG. 3, each of the shaft insertion holes 20*b* and 22*b* of the first and third storages 20 and 22 are configured such that, as the guide protrusion 10*c* of the case body 10 is inserted inside the shaft insertion holes 20*b* and 22*b*, a position of the protective buffer member 16 with respect to the case body 10 is regulated and the protective buffer member 16 is positioned. In addition, as one end of the spring member 19 is inserted into each of the shaft insertion holes 20*b* and 22*b* and is brought into elastic contact with a distal end of the guide protrusion 10*c* of the case body 10, one end of the spring member 19 is positionally regulated and held.

Meanwhile, among the first to third storages 20 to 22, the second storage 21 on the 3 o'clock side is formed in a substantially cylindrical shape having a diameter smaller than diameters of the first and third storages 20 and 22, as illustrated in FIGS. 2, 4 to 7A, and 7B. That is, the second storage 21 is configured to store the operation head 18 having the size smaller than the outer diameter of each of the operation heads 18 on the 4 o'clock side and the 2 o'clock side. In this case, the second storage 21 on the 3 o'clock side is formed in a substantially cylindrical shape having no bottom, and is configured such that the through-hole 10*b* on the 3 o'clock side of the case body 10 is exposed to the outside.

Figure 4:
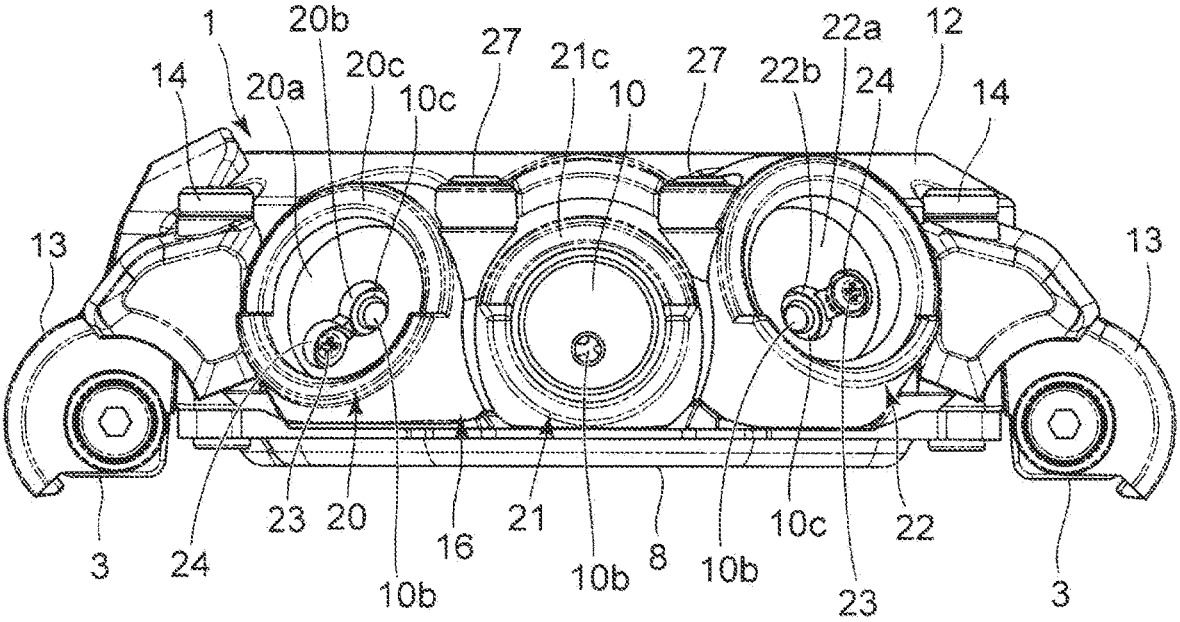
FIG. 4 is an enlarged side view illustrating a state where some of operation members are removed from the wristwatch illustrated in FIG. 2.
Figure 7A:
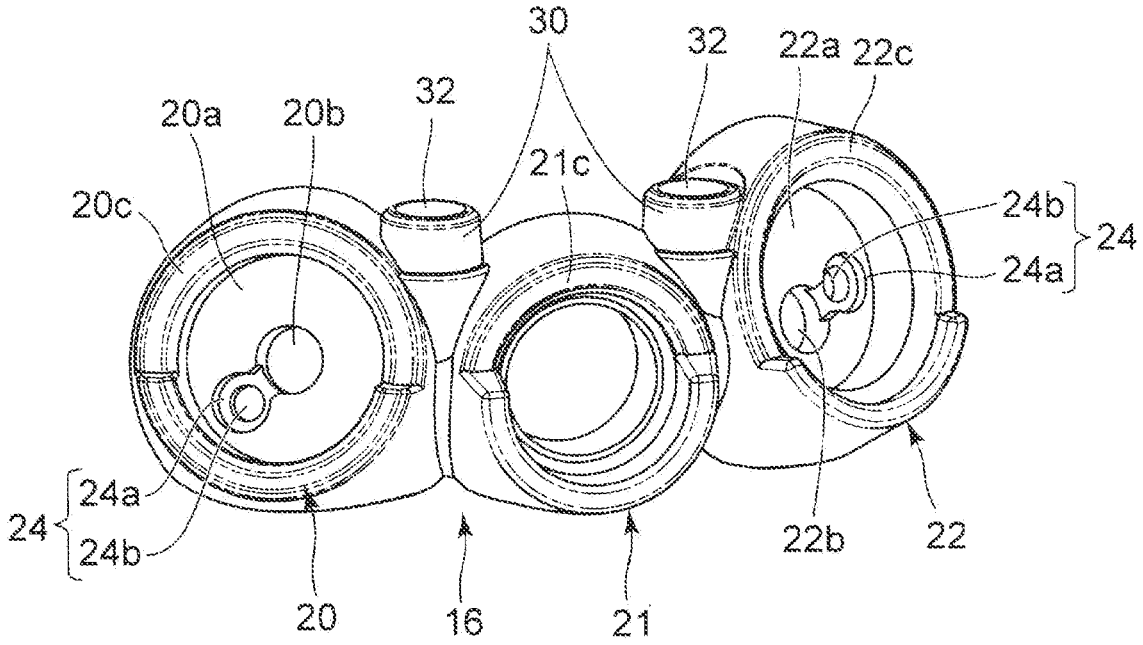
FIG. 7A is an enlarged perspective view illustrating an appearance of the protective buffer member illustrated in FIG. 5.
Figure 7B:
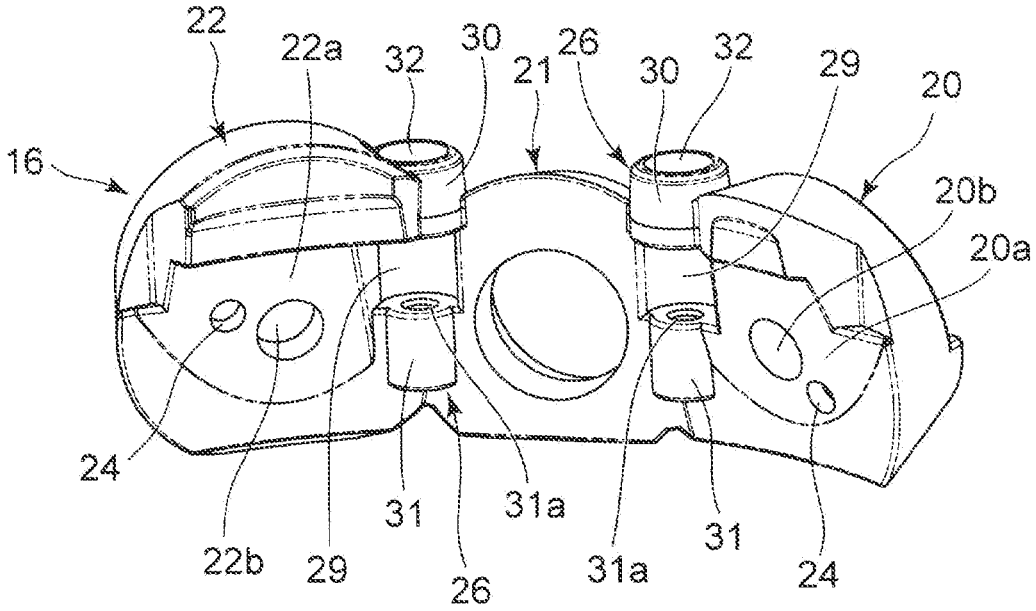
FIG. 7B is an enlarged perspective view illustrating an inner surface side of the protective buffer member illustrated in FIG. 5.

Meanwhile, the operation members 15 on the 2 o'clock side, the 3 o'clock side, and the 4 o'clock side are provided radially from the center of the inside of the case body 10 as illustrated in FIGS. 1 and 2. In this case, the operation member 15 on the 4 o'clock side is integrally provided with the operation shaft 17 at the center of the inner surface in the recess 18*a* of the operation head 18 as illustrated in FIG. 3. As a result, the first storage 20 is provided with the shaft insertion hole 20*b* at the center of the bottom 20*a* as illustrated in FIGS. 4, 7A, and 7B.

In addition, the operation member 15 on the 4 o'clock side is inclined such that the operation shaft 17 rises in the vertical direction, which is the front and back surface direction of the case body 10, from the inside to the outside of the case body 10 as illustrated in FIG. 3. That is, the operation shaft 17 of the operation member 15 is inserted into the through-hole 10*b* on the 4 o'clock side of the case body 10 in the state of being inclined at a predetermined inclination angle, for example, an inclination angle of 15°, in the vertical direction. In this case, the through-hole 10*b* on the 4 o'clock side of the case body 10 is provided to be inclined in the vertical direction, which is similar to the operation shaft 17.

Although not illustrated, the operation member 15 on the 2 o'clock side is integrally provided with the operation shaft 17 at a position biased downward from the center of the inner surface of the recess 18*a* of the operation head 18. As a result, the third storage 22 is provided with the shaft insertion hole 22*b* at a position biased downward from the center of the bottom 22*a* as illustrated in FIGS. 4, 7A, and 7B. In addition, in the operation member 15 on the 2 o'clock side, the operation shaft 17 is inclined in the vertical direction at a predetermined inclination angle, for example, an inclination angle of 15°, which is similar to the operation shaft 17 on the 4 o'clock side. Even in this case, the through-hole 10*b* on the 2 o'clock side of the case body 10 is provided to be inclined in the vertical direction, which is similar to the operation shaft 17 on the 2 o'clock side.

In addition, although not illustrated, the operation member 15 on the 3 o'clock side is integrally provided with the operation shaft 17 at a position biased downward from the center of the inner surface of the recess 18*a* of the operation head 18. The operation member 15 on the 3 o'clock side is inserted into the through-hole 10*b* on the 3 o'clock side of the case body 10 in a state where the operation shaft 17 is substantially parallel to front and back surfaces of the case body 10, which is different from the operation shafts 17 on the 4 o'clock side and the 2 o'clock side.

As a result, the through-hole 10*b* on the 3 o'clock side is provided in an outer surface of the case body 10 on a 3 o'clock side at a position biased downward from a portion corresponding to the center of the second storage 21 as illustrated in FIG. 4. The through-hole 10*b* on the 3 o'clock side is provided substantially parallel to the front and back surfaces of the case body 10, which is similar to the operation shaft on the 3 o'clock side.

As illustrated in FIGS. 1 to 5 and 7A and 7B, each of the first to third storages 20 to 22 has a structure in which each of notches 20*c* to 22*c* is provided in an upper semicircular portion of an outer peripheral end. Therefore, each of the first to third storages 20 to 22 is formed such that a lower semicircular portion on the outer peripheral end is at substantially the same height as an outer end surface of the stored operation head 18, and the upper semicircular portion is lower than the outer end surface of the operation head 18 by one step due to each of the notches 20*c* to 22*c*. As a result, the first to third storages 20 to 22 are configured such that the stored operation head 18 is easily pressed.

In addition, as illustrated in FIGS. 4 to 7A and 7B, the protective buffer member 16 is configured such that the bottoms 20*a* and 22*a* of the first storage 20 on the 4 o'clock side and the third storage 22 on the 2 o'clock side located on both sides are fastened to the outer surface of the case body 10 by second screw members 23 which are fastening members. That is, screw attachment holes 24 are provided in both of the bottoms 20*a* and 22*a* of the first storage 20 and the third storage 22. In addition, in the case body 10, second screw holes 25 into which the second screw members 23 are screwed are provided on the same axis as the screw attachment holes 24.

In this case, as illustrated in FIGS. 4 and 7A, each of the screw attachment holes 24 of the first storage 20 and the third storage 22 includes a large-diameter hole 24*a* in which a head of the second screw member 23 is disposed, and a small-diameter hole 24*b* into which a threaded portion of the second screw member 23 is inserted. Among these screw attachment holes 24, the screw attachment hole 24 of the first storage 20 is provided, at a position corresponding to the recess 18*a* of the operation head 18, to be located obliquely downward from the shaft insertion hole 20*b* of the bottom 20*a* toward the 5 o'clock side. The screw attachment hole 24 of the third storage 22 is provided at a position corresponding to the recess 18*a* of the operation head 18 to be located obliquely upward from the shaft insertion hole 22*b* of the bottom 22*a* toward the 1 o'clock side.

Accordingly, among the second screw holes 25 of the case body 10, the second screw hole 25 corresponding to the first storage 20 is located obliquely downward from the through-hole 10*b* of the case body 10 toward the 5 o'clock side and is provided so as to correspond to the screw attachment hole 24 of the first storage 20 on the same axis as illustrated in FIGS. 4 to 7A and 7B. The second screw hole 25 corresponding to the third storage 22 is located obliquely upward from the through-hole 10*b* of the case body 10 toward the 1 o'clock side, and is provided coaxially with the screw attachment hole 24 of the third storage 22.

As a result, the protective buffer member 16 is configured such that each of the bottoms 20*a* and 22*a* of the first storage 20 on the 4 o'clock side and the third storage 22 on the 2 o'clock side is attached to the outer surface of the case body 10 by the second screw member 23 to prevent an end on the 5 o'clock side in the first storage 20 on the 4 o'clock side and an end on the 1 o'clock side in the third storage 22 on the 2 o'clock side from being turned up with respect to the case body 10, as illustrated in FIGS. 4 and 5.

In addition, as illustrated in FIGS. 5 to 8, the protective buffer member 16 is configured so as to be attached to the outer surface of the case body 10 as fitting attachment portions 26 provided on both an outer surface of the case body 10 and an inner surface of the protective buffer member 16 facing the outer surface are fastened in the front and back surface direction (vertical direction) of the case body 10 by a third screw member 27 which is a fastening member. In addition, the third screw member 27 and the respective operation members 15 on the 2 o'clock side, the 3 o'clock side, and the 4 o'clock side are disposed so as not to overlap each other on the outer surface (outer circumferential direction) of the case body 10 as illustrated in FIGS. 1, 2, and 5 to 8.

In this case, as illustrated in FIGS. 5 to 7A and 7B, the fitting attachment portions 26 are provided on both sides of the second storage 21, which is an intermediate portion among the first to third storages 20 to 22 of the protective buffer member 16, that is, at two places between the first and second storages 20 and 21 and between the second and third storages 21 and 22. These two fitting attachment portions 26 are fastened in the upper and lower surface direction, which is the vertical direction of the case body 10, by the third screw member 27 to press and attach the protective buffer member 16 to the outer surface of the case body 10.

That is, as illustrated in FIGS. 5 to 8, the fitting attachment portion 26 includes a fixing protrusion 28 provided to protrude on the outer surface of the case body 10, a fitting recess 29 which is provided in a substantially intermediate portion in the vertical direction on the inner surface of the protective buffer member 16 and into which the fixing protrusion 28 is fitted, and two attachment protrusions 30 and 31, each of which is provided to protrude on inner surface of the protective buffer member 16 located above and below the fitting recess 29, and which face upper and lower surfaces of the fixing protrusion 28.

As a result, the fitting attachment portion 26 is configured such that the attachment protrusion 30 on the upper side of the protective buffer member 16 is disposed to face the upper side of the fixing protrusion 28 and the attachment protrusion 31 on the lower side of the protective buffer member 16 is disposed to face the lower side of the fixing protrusion 28 when the fixing protrusion 28 of the case body 10 is fitted into the fitting recess 29 of the protective buffer member 16 as illustrated in FIGS. 5 to 8.

Figure 8:
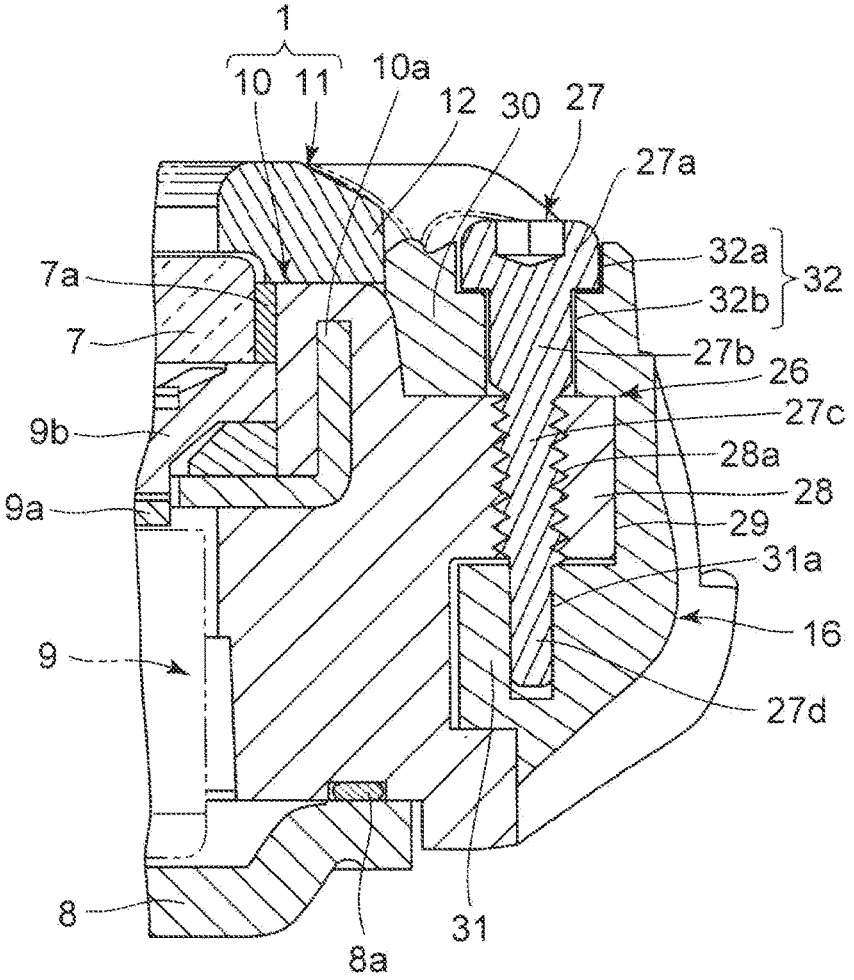
FIG. 8 is an enlarged cross-sectional view illustrating main parts of the wristwatch illustrated in FIG. 1 in view B-B.

In this case, a third screw hole 28*a* is provided in the fixing protrusion 28 of the case body 10 so as to penetrate in the vertical direction, which is the front and back surface direction, of the case body 10 as illustrated in FIGS. 6 to 8. The attachment protrusion 30, located above the fitting recess 29 of the protective buffer member 16, is provided with a first screw insertion hole 32 which corresponds to the third screw hole 28*a* of the fixing protrusion 28 on the same axis and penetrates in the vertical direction. In addition, the attachment protrusion 31, located below the fitting recess 29 of the protective buffer member 16, is provided with a second screw insertion hole 31*a* which corresponds to the third screw hole 28*a* of the fixing protrusion 28 on the same axis without penetrating in the vertical direction.

Figure 9:
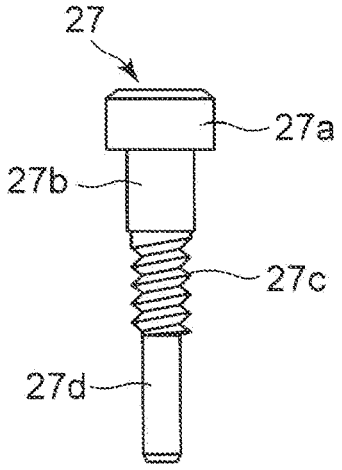
FIG. 9 is an enlarged front view illustrating a screw member illustrated in FIG. 8.

As illustrated in FIGS. 8 and 9, the third screw member 27 includes a head 27*a*, a neck 27*b*, a threaded portion 27*c*, and a non-threaded portion 27*d*. The third screw member 27 is configured to fasten the upper and lower attachment protrusions 30 and 31 to the fixing protrusion 28 and press and attach the protective buffer member 16 to the outer surface of the case body 10 in a state where the head 27*a* and the neck 27*b* are inserted into the first screw insertion hole 32 of the upper attachment protrusion 30, the threaded portion 27*c* is screwed into the third screw hole 28*a* of the fixing protrusion 28 and the non-threaded portion 27*d* is inserted into the second screw insertion hole 31*a* of the lower attachment protrusion 31.

In this case, the head 27*a* is formed to have an outer diameter larger than an outer diameter of the neck 27*b* and an axial length shorter than a length of the neck 27*b* as illustrated in FIGS. 8 and 9. The neck 27*b* is formed to have the outer diameter larger than an outer diameter of the threaded portion 27*c* and an axial length substantially the same as a length of the threaded portion 27*c*. The non-threaded portion 27*d* is formed in a simple rod shape, is formed to have an outer diameter smaller than the outer diameter of the threaded portion 27*c*, that is, a root diameter of a screw groove, and is formed to have an axial length substantially the same as the lengths of the neck 27*b* and the threaded portion 27*c*.

In addition, the first screw insertion hole 32 of the upper attachment protrusion 30 includes: a large-diameter hole 32*a* into which the head 27*a* of the third screw member 27 is inserted and disposed; and a small-diameter hole 32*b* into which the neck 27*b* of the third screw member 27 is inserted as illustrated in FIG. 8. In this case, the large-diameter hole 32*a* is formed to have an axial length substantially the same as the axial length of the head 27*a*. The small-diameter hole 32*b* is formed to have an axial length slightly longer than the axial length of the neck 27*b* such that the neck 27*b* does not abut on the fixing protrusion 28 when the third screw member 27 is tightened.

As illustrated in FIG. 8, the second screw insertion hole 31*a* of the lower attachment protrusion 31 is formed such that an inner diameter thereof is smaller than an inner diameter of the third screw hole 28*a* of the fixing protrusion 28, that is, an inner diameter of a crest of the screw groove, and is the same size as an outer diameter of the non-threaded portion 27*d* of the third screw member 27. The second screw insertion hole 31*a* is a hole that does not penetrate the lower side of the lower attachment protrusion 31 and is formed to have an axial length longer than the axial length of the non-threaded portion 27*d*, and is formed such that a distal end of the non-threaded portion 27*d* does not abut on a back portion of the second screw insertion hole 31*a* when the third screw member 27 is tightened.

As a result, the protective buffer member 16 is configured such that upper and lower edges of the protective buffer member 16 are not turned up with respect to the case body 10 since the protective buffer member 16 is pressed against the outer surface of the case body 10 when the upper attachment protrusion 30 is fixed to the fixing protrusion 28 and the lower attachment protrusion 31 is tightened to the fixing protrusion 28 between the upper and lower attachment protrusions 30 and 31 located on both sides of the second storage 21 due to the fastening of the two third screw members 27, and the two fitting attachment portions 26 located on both sides of the second storage 21 are fastened in the vertical direction as illustrated in FIG. 8.

That is, the protective buffer member 16 is configured such that the upper edge of the protective buffer member 16 is prevented from being turned up by the head 27*a* and the neck 27*b* of the third screw member 27 since the head 27*a* and the neck 27*b* of the third screw member 27 screwed to the fixing protrusion 28 of the case body 10 are inserted into the first screw insertion hole 32 of the upper attachment protrusion 30, the upper attachment protrusion 30 is fixed to the fixing protrusion 28 of the case body 10, and the protective buffer member 16 is pressed against the outer surface of the case body 10 as illustrated in FIG. 8.

In addition, as illustrated in FIG. 8, the protective buffer member 16 is configured such that the lower edge of the protective buffer member 16 is prevented from being turned up by the non-threaded portion 27*d* of the third screw member 27 since the non-threaded portion 27*d* of the third screw member 27 screwed to the fixing protrusion 28 of the case body 10 is inserted into the second screw insertion hole 31*a* of the lower attachment protrusion 31, the lower attachment protrusion 31 is fastened to the fixing protrusion 28 of the case body 10, and the protective buffer member 16 is pressed against the outer surface of the case body 10.

Next, a case of assembling the above wristwatch will be described.

In this case, first, the timepiece glass 7 is mounted and attached to an upper opening of the case body 10 together with the glass gasket 7*a*. In this state, the protective buffer member 16 is attached to the outer peripheral surface of the case body 10 from the 2 o'clock side to the 4 o'clock side.

At this time, the two fitting attachment portions 26 located on both sides of the second storage 21 located in the intermediate portion among the first to third storages 20 to 22 of the protective buffer member 16, that is, between the first and second storages 20 and 21 and between the second and third storages 21 and 22 are respectively fitted. That is, the two fixing protrusions 28 of the case body 10 are respectively fitted into the two fitting recesses 29 of the protective buffer member 16. Then, the attachment protrusions 30 and 31 of the two fitting attachment portions 26 are disposed above and below the two fixing protrusions 28, respectively.

Each of the first screw insertion holes 32 of the two upper attachment protrusions 30 and each of the second screw insertion holes 31*a* of the two lower attachment protrusions 31 are made to correspond to each of the third screw holes 28*a* of the two fixing protrusions 28 on the same axis. As a result, the protective buffer member 16 is positioned and disposed on the outer surface of the case body 10. At this time, the shaft insertion hole 20*b* of the bottom 20*a* in the first storage 20 on the 4 o'clock side corresponds to the through-hole 10*b* on the 4 o'clock side of the case body 10, and the guide protrusion 10*c* on the 4 o'clock side of the case body 10 is inserted into the shaft insertion hole 20*b* of the first storage 20.

Similarly, the shaft insertion hole 22*b* of the bottom 22*a* of the third storage 22 on the 2 o'clock side corresponds to the through-hole 10*b* on the 2 o'clock side of the case body 10, and the guide protrusion 10*c* on the 2 o'clock side of the case body 10 is inserted into the shaft insertion hole 22*b* of the bottom 22*a* of the third storage 22. As a result, the protective buffer member 16 is accurately positioned on the outer surface of the case body 10 as positions of the protective buffer member 16 in the vertical direction and the horizontal direction are regulated since the respective guide protrusions 10*c* on the 4 o'clock side and the 2 o'clock side of the case body 10 are inserted into the shaft insertion hole 20*b* of the first storage 20 and the shaft insertion hole 22*b* of the third storage 22, respectively.

In addition, at this time, the screw attachment holes 24, which are provided in both of the bottom 20*a* of the first storage 20 on the 4 o'clock side and the bottom 22*a* of the third storage 22 on the 2 o'clock side, correspond to the second screw holes 25 on the 4 o'clock side and the 2 o'clock side of the case body 10, respectively, on the same axis. In addition, the through-hole 10*b* of the case body 10 corresponding to the second storage 21 on the 3 o'clock side is exposed to the outside of the protective buffer member 16 through the second storage 21.

In this state, each of the bottom 20*a* of the first storage 20 and the bottom 22*a* of the third storage 22 are attached to the case body 10 by the second screw member 23, and each of the two fitting attachment portions 26 is fastened in the front and back surface direction (vertical direction) of the case body 10 by the third screw member 27, thereby attaching the protective buffer member 16 to the outer surface of the case body 10.

In this case, when the bottom 20*a* of the first storage 20 and the bottom 22*a* of the third storage 22 are attached to the case body 10, the second screw members 23 are inserted into the respective screw attachment holes 24 provided in the bottom 20*a* of the first storage 20 and the bottom 22*a* of the third storage 22, and screwed and tightened into the respective second screw holes 25 of the case body 10.

Then, the heads of the second screw members 23 are disposed in the large-diameter holes 24*a* of the screw attachment holes 24 to press the small-diameter holes 24*b* of the screw attachment holes 24. As a result, the protective buffer member 16 is attached to the outer surface of the case body 10, so that the edges on the both end sides of the protective buffer member 16 located on each end side of the first and third storages 20 and 22 of the protective buffer member 16, that is, on the 5 o'clock side and the 1 o'clock side from being turned up.

That is, the second screw hole 25 on the 4 o'clock side corresponding to the first storage 20 is located obliquely downward from the through-hole 10*b* on the 4 o'clock side of the case body 10 toward the 5 o'clock side at a place corresponding to the recess 18*a* of the operation head 18. In addition, the second screw hole 25 on the 2 o'clock side corresponding to the third storage 22 is located obliquely upward from the through-hole 10*b* on the 2 o'clock side of the case body 10 toward the 1 o'clock side at a place corresponding to the recess 18*a* of the operation head 18.

As a result, when the protective buffer member 16 is attached to the outer surface of the case body 10 by the second screw member 23, the end on the 5 o'clock side of the bottom 20*a* of the first storage 20 and the end on the 1 o'clock side of the bottom 22*a* of the third storage 22 are fixed to the case body 10. Therefore, in the protective buffer member 16, an end on the 5 o'clock side in the first storage 20 on the 4 o'clock side and an end on the 1 o'clock side in the third storage 22 on the 2 o'clock side are not turned up with respect to the case body 10.

In addition, when the two fitting attachment portions 26 are fastened in the vertical direction of the case body 10 by the third screw members 27, the threaded portions 27*c* of the two third screw members 27 are inserted into the first screw insertion holes 32 of the two attachment protrusions 30 on the upper side, and screwed into the third screw holes 28*a* of the two fixing protrusions 28 of the case body 10.

At this time, the non-threaded portions 27*d* are gradually inserted into the second screw insertion holes 31*a* of the two lower attachment protrusions 31, respectively, while each of the threaded portions 27*c* is gradually screwed into each of the third screw holes 28*a* as the threaded portions 27*c* of the two third screw members 27 are screwed, and the necks 27*b* are gradually inserted into the small-diameter holes 32*b* of the first screw insertion hole 32 of the upper attachment protrusions 30, respectively.

When each the two third screw members 27 is tightened and each of the threaded portions 27*c* is screwed into the third screw hole 28*a*, the non-threaded portions 27*d* is inserted and disposed in the second screw insertion hole 31*a* of each of the two lower attachment protrusions 31, each of the necks 27*b* is inserted and disposed in the small-diameter hole 32*b* of the first screw insertion hole 32, and each of the head 27*a* is inserted and disposed in the large-diameter hole 32*a* of the first screw insertion hole 32.

Therefore, the two upper and lower attachment protrusions 30 and 31 positioned on both the sides of the second storage 21 are attached to the fixing protrusions 28 by tightening of the two third screw members 27, and the two fitting attachment portions 26 located on both the sides of the second storage 21 are fastened in the vertical direction. As a result, the protective buffer member 16 is pressed against and attached to the outer surface of the case body 10. In this state, the two third screw members 27 prevent the edges located above and below the protective buffer member 16 from being turned up with respect to the case body 10.

That is, the protective buffer member 16 is pressed against the outer surface of the case body 10 as the upper attachment protrusion 30 of the protective buffer member 16 is fixed to the fixing protrusion 28 of the case body 10 by the head 27*a* and the neck 27*b* of the third screw member 27, so that the edge on the upper side of the protective buffer member 16 is reliably prevented from being turned up by the head 27*a* and the neck 27*b* of the third screw member 27.

In addition, the protective buffer member 16 is pressed against the outer surface of the case body 10 as the lower attachment protrusion 31 of the protective buffer member 16 is attached to the fixing protrusion 28 of the case body 10 by the non-threaded portion 27*d* of the third screw member 27, so that the edge on the lower side of the protective buffer member 16 is reliably prevented from being turned up by the non-threaded portion 27*d* of the third screw member 27.

Then, the three operation members 15 of switch device 4, operation members (not illustrated) of the pushbutton switches 5 on the 8 o'clock side and the 10 o'clock side, and an operation member (not illustrated) of the upper surface switch 6 are attached to the case body 10. In this case, when the three operation members 15 of the switch device 4 are attached, the operation shafts 17 of the operation members 15 on the 4 o'clock side and the 2 o'clock side are inserted into the through-holes 10*b* of the case body 10 from the shaft insertion holes 20*b* and 22*b* of the first and third storages 20 and 22 of the protective buffer member 16, respectively, and the operation shaft 17 on the 3 o'clock side is inserted into the through-hole 10*b* of the case body 10 from the second storage 21 of the protective buffer member 16.

That is, when the operation member 15 on the 4 o'clock side among the three operation members 15 is attached to the case body 10, the plurality of waterproof rings 17*b* are attached in advance to the outer peripheral surface of the operation shaft 17, and the spring member 19 is disposed on the outer circumference of the operation shaft 17. In this state, the operation shaft 17 on the 4 o'clock side is inserted into the shaft insertion hole 20*b* of the bottom 20*a* of the first storage 20 from the outside of the first storage 20 on the 4 o'clock side of the protective buffer member 16 and is inserted into the through-hole 10*b* on the 4 o'clock side of the case body 10.

Then, the plurality of waterproof rings 17*b* provided on the outer peripheral surface of the operation shaft 17 on the 4 o'clock side are inserted into the through-holes 10*b* of the case body 10, and one end of the spring member 19 is inserted into the shaft insertion hole 20*b* of the first storage 20 to come into elastic contact with the guide protrusion 10*c* of the case body 10. Then, the other end of the spring member 19 comes into elastic contact with the inner surface of the operation head 18. At this time, as the one end of the spring member 19 is inserted into the shaft insertion hole 20*b* of the first storage 20, the spring member 19 is positionally regulated and held.

In this state, when the operation head 18 on the 4 o'clock side is pushed into the first storage 20, the inner end of the operation shaft 17 protrudes to the inside of the case body 10. The retaining member 17*a*, such as an E-ring, is attached to the protruding inner end of the operation shaft 17. As a result, even when the operation head 18 of the operation member 15 on the 4 o'clock side is pushed out toward the outside of the case body 10 by a spring force of the spring member 19, the retaining member 17*a* abuts on the inner surface of the case body 10, and thus, the operation member 15 on the 4 o'clock side is attached to the case body 10 without coming out of the case body 10.

Similarly, the operation member 15 on the 2 o'clock side is attached to the case body 10. Even at this time, the plurality of waterproof rings 17*b* are attached in advance to the outer peripheral surface of the operation shaft 17, and the spring member 19 is disposed on the outer circumference of the operation shaft 17. In this state, the operation shaft 17 on the 2 o'clock side is inserted into the shaft insertion hole 22*b* of the bottom 22*a* of the third storage 22 from the outside of the third storage 22 on the 2 o'clock side of the protective buffer member 16, and is inserted into the through-hole 10*b* on the 2 o'clock side of the case body 10.

Then, the plurality of waterproof rings 17*b* provided on the outer peripheral surface of the operation shaft 17 on the 2 o'clock side are inserted into the through-holes 10*b* on the 2 o'clock side of the case body 10, and one end of the spring member 19 is inserted into the shaft insertion hole 22*b* of the third storage 22 to come into elastic contact with the guide protrusion 10*c* of the case body 10. Then, the other end of the spring member 19 comes into elastic contact with the inner surface of the operation head 18. Even at this time, as the one end of the spring member 19 is inserted into the shaft insertion hole 22*b* of the third storage 22, the spring member 19 is positionally regulated and held.

In this state, when the operation head 18 on the 2 o'clock side is pushed into the third storage 22, the inner end of the operation shaft 17 on the 2 o'clock side protrudes to the inside of the case body 10 similarly to the operation member 15 on the 4 o'clock side. The retaining member 17*a*, such as an E-ring, is attached to the protruding inner end of the operation shaft 17. As a result, even when the operation head 18 of the operation member 15 on the 2 o'clock side is pushed out toward the outside of the case body 10 by a spring force of the spring member 19, the retaining member 17*a* abuts on the inner surface of the case body 10, and thus, the operation member 15 on the 2 o'clock side is attached to the case body 10 without coming out of the case body 10.

In addition, when the operation member 15 on the 3 o'clock side is attached to the case body 10, the plurality of waterproof rings 17*b* are attached in advance to the outer peripheral surface of the operation shaft 17 on the 3 o'clock side, and the spring member 19 is disposed on the outer circumference of the operation shaft 17, which is similar to the respective operation members 15 on the 4 o'clock side and the 2 o'clock side. In this state, the operation shaft 17 on the 3 o'clock side is inserted from the outside to the inside of the second storage 21 on the 3 o'clock side of the protective buffer member 16, and is inserted into the through-hole 10*b* on the 3 o'clock side of the case body 10.

Then, the plurality of waterproof rings 17*b* provided on the outer peripheral surface of the operation shaft 17 on the 3 o'clock side are inserted into the through-holes 10*b* of the case body 10, and one end of the spring member 19 is brought into elastic contact with the outer surface of the case body 10, and the other end of the spring member 19 is brought into elastic contact with the inner surface of the operation head 18. In this state, when the operation head 18 on the 3 o'clock side is pushed into the second storage 21, the inner end of the operation shaft 17 protrudes to the inside of the case body 10.

The retaining member 17*a*, such as an E-ring, is attached to the protruding inner end of the operation shaft 17 on the 3 o'clock side. As a result, even when the operation head 18 of the operation member 15 on the 3 o'clock side is pushed out toward the outside of the case body 10 by a spring force of the spring member 19, the retaining member 17*a* abuts on the inner surface of the case body 10, and thus, the operation member 15 on the 3 o'clock side is attached to the case body 10 without coming out of the case body 10, which is similar to the operation members 15 on the 4 o'clock side and the 2 o'clock side.

Then, the operation members (not illustrated) of the pushbutton switches 5 are attached to the 8 o'clock side and the 10 o'clock side of the case body 10, respectively, and the operation member (not illustrated) of the upper surface switch 6 is attached to the 6 o'clock side of the case body 10. In this state, the exterior member 11 is attached to the case body 10. At this time, the first cover 12 of the exterior member 11 is disposed on the upper surface of the case body so as to cover the case body 10, and the two second covers 13 of the exterior member 11 are disposed on the band attachment portions 3 on the 12 o'clock side and the 6 o'clock side of the case body 10 so as to cover the band attachment portions 3, respectively.

In this case, when the second cover 13 on the 6 o'clock side is disposed on the band attachment portion 3 on the 6 o'clock side, the switch opening 13*a* provided in the second cover 13 is disposed so as to correspond to the upper surface switch 6 attached to the 6 o'clock side of the case body 10, and the upper surface switch 6 is exposed from the switch opening 13*a* of the second cover 13 in a switchable manner.

In this state, the first cover 12 and the two second covers 13 are attached to the band attachment portions 3 on the 12 o'clock side and the 6 o'clock side of the case body 10 by the plurality of first screw members 14. As a result, the wristwatch case 1 is assembled. Then, the timepiece module 9 is inserted into the case body 10 from below, and the back lid 8 is attached to the lower portion of the case body 10 together with the waterproof gasket 8*a*. As a result, the wristwatch is assembled.

Next, a function of the switch device 4 of the above wristwatch will be described.

In the switch device 4, normally, the operation heads 18 of the three operation members 15 from the 2 o'clock side to the 4 o'clock side are pushed out to the outside of the case body 10 by the spring force of the spring member 19, and the operation heads 18 are stored in the first to third storages 20 to 22, respectively.

In this case, the retaining members 17*a* provided at the inner ends of the respective operation shafts 17 of the three operation members 15 abut on the inner surface of the case body 10 so that the respective operation shafts 17 do not come out of the case body 10. Therefore, in the switch device 4, the three operation heads 18 from the 2 o'clock side to the 4 o'clock side are protected by the first to third storages 20 to 22 of the protective buffer member 16 so as not to receive an impact from the vertical direction of the case body 10.

In this state, when each of the operation heads 18 of the three operation members 15 is pressed against the spring force of the spring member 19, the inner end of each of the operation shafts 17 is pushed into the case body 10 to press each contact portion (not illustrated) of the timepiece module 9 in the case body 10. As a result, each contact portion performs a switching operation to be turned on. In addition, when the operation of pressing the respective operation heads 18 is released, the three operation members 15 are pushed out by the spring force of the spring member 19 to return to the initial positions, and each contact portion is turned off.

In addition, when each of the operation heads 18 on the 4 o'clock side and the 2 o'clock side among the three operation heads 18 on the 2 o'clock side to the 4 o'clock side receives an impact from the side of the case body 10, the operation heads 18 are pressed against the bottoms 20*a* and 22*a* of the first and third storages 20 and 22 against the spring force of the spring member 19 of each of the operation members 15, and thus, the impact is buffered by the bottoms 20*a* and 22*a*.

Therefore, even when the operation heads 18 on the 4 o'clock side and the 2 o'clock side receive an impact from the side of the case body 10, and breakages of the operation members 15 on the 4 o'clock side and the 2 o'clock side can be prevented, and the impact of each of the operation heads 18 is not transmitted to the case body 10. Thus, it is possible to prevent breakages of the timepiece module 9 in the case body 10 and parts mounted on the timepiece module 9.

That is, the protective buffer member 16 is made of a urethane resin having elasticity. Thus, when the operation heads 18 on the 4 o'clock side and the 2 o'clock side receive an impact and are pressed against the bottoms 20*a* and 22*a* of the first and third storages 20 and 22, the impact received by each of the operation heads 18 is buffered by the elasticity of each of the bottoms 20*a* and 22*a*.

In this case, the protective buffer member 16 is made of a urethane resin having high hardness of rank D which has a buffering property in urethane resins having high hardness of ranks C to E among the urethane resins having hardness of ranks A to E, and thus, it is possible to satisfactorily buffer the impact when each of the operation heads 18 abuts on each of the bottoms 20*a* and 22*a* of the first and second storages 20 and 22.

In addition, the bottoms 20*a* and 22*a* of the first and second storages 20 and 22 are formed to have a wall thickness equal to or larger than a wall thickness of each outer peripheral wall of the first and second storages 20 and 22. Thus, it is possible to more reliably and satisfactorily buffer the impact when each of the operation heads 18 abuts on each of the bottoms 20*a* and 22*a* of the first and second storages 20 and 22.

In addition, when the bottoms 20*a* and 22*a* of the first and third storages 20 and 22 among the first to third storages 20 to 22 of the protective buffer member 16 are attached to the outer surface of the case body 10 by the second screw member 23, which is the fastening member, the heads of the second screw members 23 are disposed in the large-diameter holes 24*a* of the screw attachment holes 24 of the bottoms 20*a* and 22*a*, respectively, at positions corresponding to the recesses 18*a* of the operation heads 18, and the threaded portions of the second screw members 23 are inserted into the small-diameter holes 24*b* of the screw attachment holes 24 of the bottoms 20*a* and 22*a*, respectively, and are screwed into the second screw holes 25 of the case body 10.

Therefore, each of head of each of the second screw members 23 does not protrude to the inside of each of the first and third storages 20 and 22. As a result, when each of the operation heads 18 is pressed against each of the bottoms 20*a* and 22*a* of the first and third storages 20 and 22 by the external impact, the inner end surfaces of the operation heads 18 are not pressed against the heads of the second screw members 23 since the heads of the second screw members 23 are provided at the positions corresponding to the recesses 18*a* of the operation heads 18 and disposed in the large-diameter holes 24*a* of the screw attachment holes 24, respectively. Therefore, the impact received by each of the operation heads 18 is satisfactorily buffered by each of the bottoms 20*a* and 22*a* of the first and third storages 20 and 22.

On the other hand, the bottom 20*a* of the first storage 20 and the bottom 22*a* of the third storage 22 in the protective buffer member 16 are attached to the case body 10 by the two second screw members 23. Thus, even if an external force, such as an impact, is applied from the outer circumferential direction of the case body 10 to both end sides of the protective buffer member 16 on the 2 o'clock side and the 4 o'clock side, the edges on the end sides of the first and third storages 20 and 22 of the protective buffer member 16, that is, on both end sides of the protective buffer member 16 located on the 5 o'clock side and the 1 o'clock side are not turned up with respect to the case body 10 by the external force.

That is, the end on the 5 o'clock side of the bottom 20*a* of the first storage 20 and the end on the 1 o'clock side of the bottom 22*a* of the third storage 22 are fixed to the case body 10 by the second screw members 23 in the protective buffer member 16.

Therefore, even when the end on the 5 o'clock side in the first storage 20 on the 4 o'clock side and the end on the 1 o'clock side in the third storage 22 on the 2 o'clock side receive an external force, such as an impact, from the outer circumferential direction of the case body 10 in the protective buffer member 16, the end on the 5 o'clock side and the end on the 1 o'clock side of the protective buffer member 16 are not turned up with respect to the case body 10 by the external force.

In addition, the two fitting attachment portions 26 located on both sides of the second storage 21 are fastened in the vertical direction by the two third screw members 27 and are pressed against and attached to the outer surface of the case body 10 in the protective buffer member 16. Thus, even if an external force, such as an impact, is applied from the vertical direction of the case body 10, the vertically located edges of the protective buffer member 16 are not turned up with respect to the case body 10 by the external force.

That is, the two upper attachment protrusions 30 are fixed to the two fixing protrusions 28 of the case body 10 by the heads 27*a* and the necks 27*b* of the two third screw members 27 and pressed against the outer surface of the case body 10 in the protective buffer member 16. Thus, even if an external force, such as an impact, is applied from the upper side of the protective buffer member 16, the upper edge of the protective buffer member 16 is not turned up with respect to the case body 10 by the external force.

In addition, the two lower attachment protrusions 31 are fastened to the two fixing protrusions 28 of the case body 10 by the non-threaded portions 27*d* of the two third screw members 27 and pressed against the outer surface of the case body 10 in the protective buffer member 16. Thus, even if an external force, such as an impact, is applied from the lower side of the protective buffer member 16, the lower edge of the protective buffer member 16 is not turned up with respect to the case body 10 by the external force.

In this manner, the switch device 4 of the wristwatch includes the case body 10 provided with the plurality of through-holes 10*b*, the plurality of operation members 15, each of which having the operation shaft 17 to be inserted into the through-hole 10*b* of the case body 10 and the operation head 18 provided at the outer end of the operation shaft 17, and the protective buffer member 16 made of the synthetic resin having elasticity and attached to the outer surface of the case body 10. The protective buffer member 16 includes the first and third storages 20 and 22 that have bottoms 20*a* and 22*a*, respectively, facing the inner end surfaces of the plurality of operation heads 18 and that store the operation heads 18 and, thus, it is possible to improve impact resistance by buffering the external impact.

That is, in the switch device 4, when each of the operation heads 18 of the plurality of operation members 15 receives the impact from the outside of the case body 10, the operation heads 18 can be made to abut on the bottoms 20*a* and 22*a* of the first and third storages 20 and 22. Thus, the external impact can be buffered by the elasticity of each of the bottoms 20*a* and 22*a* and, as a result, the impact received from the outside by each of the operation heads 18 is prevented from being transmitted to the case body 10.

Therefore, in the switch device 4, it is possible to prevent each of the operation members 15 from being damaged by the external impact, and the impact generated when each of the operation heads 18 abuts on each of the bottoms 20*a* and 22*a* of the first and third storages 20 and 22 is not transmitted to the case body 10. Thus, it is possible to prevent breakages of the timepiece module 9 in the case body 10 and parts mounted on the timepiece module 9, and as a result, the impact resistance can be improved.

In addition, in the switch device 4, the protective buffer member 16 is made of the urethane resin having elasticity and high hardness. Thus, when the operation heads 18 housed in the first and third storages 20 and 22 receive the impact to abut on the bottoms 20*a* and 22*a* of the first and third storages 20 and 22, respectively, the external impact can be reliably and satisfactorily buffered by an elastic force of each of the bottoms 20*a* and 22*a* of the first and third storages 20 and 22 made of the urethane resin having elasticity and high hardness.

In this case, the protective buffer member 16 is made of a urethane resin having high hardness of rank D which has a buffering property in urethane resins having high hardness of ranks C to E among the urethane resins having hardness of ranks A to E.

Thus, it is possible to reliably and satisfactorily buffer the impact when each of the operation heads 18 receiving the external impact abuts on each of the bottoms 20*a* and 22*a* of the first and second storages 20 and 22.

In addition, in the switch device 4, each of the bottoms 20*a* and 22*a* of the first and third storages 20 and 22 is formed to have a thickness equal to or larger than the thickness of each of the outer peripheral walls of the first and third storages 20 and 22. Thus, the impact received when the operation heads 18 abut on the bottoms 20*a* and 22*a* of the first and third storages 20 and 22, respectively, can be more reliably and satisfactorily buffered by the thick bottoms 20*a* and 22*a* of the first and third storages 20 and 22.

In addition, in the switch device 4, the bottoms 20*a* and 22*a* of the first and third storages 20 and 22, among the first to third storages 20 to 22 of the protective buffer member 16, are attached to the outer surface of the case body 10 by the second screw members 23, which are fastening members. Thus, the protective buffer member 16 can be easily and reliably attached to the case body 10.

That is, in the switch device 4 has a structure in which the screw attachment holes 24, into which the second screw members 23 are inserted, are provided in both of the bottoms 20*a* and 22*a* of the first and third storages 20 and 22, and the second screw holes 25 corresponding to the screw attachment holes 24 on the same axis are provided in the case body 10. Thus, the protective buffer member 16 can be easily and reliably attached to the case body 10 simply by inserting the second screw members 23 into the screw attachment holes 24 of the bottoms 20*a* and 22*a* of the first and third storages 20 and 22 and screwing the second screw members 23 into the second screw holes 25 of the case body 10.

In this case, each of the screw attachment holes 24 provided in the bottoms 20*a* and 22*a* of the first and third storages 20 and 22 includes the large-diameter hole 24*a* in which the head of the second screw member 23 is disposed and the small-diameter hole 24*b* into which the threaded portion of the second screw member 23 is inserted. Thus, when each of the second screw members 23 is inserted into each of the screw attachment holes 24 and screwed into each of the second screw holes 25 of the case body 10, the head of each of the second screw members 23 can be disposed without protruding into each of the first and second storages 20 and 22.

Therefore, in the switch device 4, when the operation heads 18 abut on the bottoms 20*a* and 22*a* of the first and second storages 20 and 22 due to the external impact, the inner end surfaces of the operation heads 18 do not come into contact with the heads of the second screw members 23 and, thus, the bottoms 20*a* and 22*a* of the first and second storages 20 and 22 can satisfactorily buffer the impact applied to each of the operation heads 18.

In addition, in the switch device 4, the three operation members 15 are provided from the 2 o'clock side to the 4 o'clock side along the outer circumference of the case body 10, and the protective buffer member 16 includes the first to third storages 20 to 22, each of which stores each of the operation heads 18 of the three operation members 15. Thus, the operation heads 18 of the three operation members 15 can be satisfactorily protected by the first to third storages 20 to 22 provided in the single protective buffer member 16. As a result, it is unnecessary to manufacture and individually attach the protective buffer member 16 for each of the first to third storages 20 to 22 and, thus, it is possible to reduce the number of parts and improve assembly workability.

Further, in the switch device 4, among the first to third storages 20 to 22 of the protective buffer member 16, the first and third storages 20 and 22 located on both sides of the 4 o'clock side and the 2 o'clock side are attached to the case body 10 by the second screw members 23. Thus, even if the protective buffer member 16 includes the first to third storages 20 to 22, it is unnecessary to individually attach the first to third storages 20 to 22 by the second screw members 23, and the protective buffer member 16 can be reliably and satisfactorily attached to the outer surface of the case body 10 by the two second screw members 23.

In this case, the bottoms 20*a* and 22*a* of the first and third storages 20 and 22 located on both sides of the 4 o'clock side and the 2 o'clock side are attached to the outer surface of the case body 10 by the second screw members 23 in the protective buffer member 16. Thus, even if an external force, such as an impact, is applied to both sides of the protective buffer member 16 on the 4 o'clock side and the 2 o'clock side in the direction along the outer circumference of the case body 10, it is possible to prevent both side portions of the protective buffer member 16 on the 4 o'clock side and the 2 o'clock side from being turned up by the external force.

In this manner, the switch device 4 of the wristwatch includes: the case body 10 provided with the through-hole 10*b*; the operation member 15 having the operation shaft 17 to be inserted into the through-hole 10*b* of the case body 10 and the operation head 18 provided at the outer end of the operation shaft 17; and the protective buffer member 16 attached to the outer surface of the case body 10 to protect the operation head 18. The fitting attachment portions 26 provided on both the outer surface of the case body 10 and the inner surface of the protective buffer member 16 facing the outer surface are fastened in the front and back surface directions of the case body 10 by the third screw members 27 in the protective buffer member 16, so that it is possible to prevent the protective buffer member 16 from being turned up by an external force such as an impact.

That is, in the switch device 4, the fitting attachment portions 26 provided on both the outer surface of the case body 10 and the inner surface of the protective buffer member 16 facing the outer surface are fastened in the front and back surface directions of the case body 10 by the third screw members 27. Thus, even if the external force, such as an impact, is applied to the protective buffer member 16 from the vertical direction, which is the front and back surface direction of the case body 10, it is possible to reliably prevent the edges of the protective buffer member 16 located on the front and back surface sides of the case body 10 from being turned up by the external force.

In this case, in the switch device 4, the fitting attachment portion 26 includes the fixing protrusion 28 provided on the outer surface of the case body 10, the fitting recess 29 which is provided on the inner surface of the protective buffer member 16 and into which the fixing protrusion 28 is fitted, and the two attachment protrusions 30 and 31 provided on the inner surface of the protective buffer member 16 and facing the front and back surface sides of the case body in the fixing protrusion 28. Thus, when the fitting attachment portion 26 is fastened by the third screw member 27, the two attachment protrusions 30 and 31 of the protective buffer member 16 can be reliably attached to the fixing protrusions 28 of the case body 10. As a result, the protective buffer member 16 can be pressed against the outer surface of the case body 10, so that the edge of the protective buffer member 16 can be reliably prevented from being turned up.

That is, in the switch device 4, the third screw holes 28*a* are provided in the fixing protrusions 28 of the case body 10 in the front and back surface directions of the case body 10. The first screw insertion hole 32 is provided in the attachment protrusion 30 of the protective buffer member 16 located on the front surface side of the case body 10 so as to correspond to the third screw hole 28*a* on the same axis. The second screw insertion hole 31*a* is provided in the attachment protrusion 31 of the protective buffer member 16 located on the back surface side of the case body 10 so as to correspond to the third screw hole 28*a* on the same axis. Thus, the two attachment protrusions 30 and 31 located on the front and back surface sides of the case body 10 are securely fastened to the fixing protrusion 28 by the third screw members 27, and the protective buffer member 16 can be favorably pressed against the outer surface of the case body 10.

In this case, in the switch device 4, the third screw member 27 includes: the head 27*a*; the neck 27*b* to be inserted into the first screw insertion hole 32 of the attachment protrusion 30 on the front surface side; the threaded portion 27*c* screwed into the screw hole 28*a* of the fixing protrusion 28; and the non-threaded portion 27*d* formed to have the diameter smaller than the outer diameter of the threaded portion 27*c* and inserted into the second screw insertion hole 31*a* of the attachment protrusion 31 on the back surface side. Thus, the attachment protrusions 30 and 31 located on the front and back surface sides of the case body 10 are securely fastened to the fixing protrusions 28 by the third screw members 27, and the protective buffer member 16 can be favorably pressed against the outer surface of the case body 10.

That is, in the switch device 4, when the third screw member 27 is screwed from the first screw insertion hole 32 of the attachment protrusion 30 on the front surface side into the third screw hole 28*a* of the fixing protrusion 28, the neck 27*b* of the third screw member 27 is inserted into the first screw insertion hole 32 of the attachment protrusion 30 on the front surface side to reliably and firmly fix the attachment protrusion 30 on the front surface side to the fixing protrusion 28. Further, the non-threaded portion 27*d* of the third screw member 27 is inserted into the second screw insertion hole 31*a* of the attachment protrusion 31 on the back surface side to reliably fasten the attachment protrusion 31 on the back surface side to the fixing protrusion 28.

In this case, the first screw insertion hole 32 of the attachment protrusion 30 on the front surface side includes: the large-diameter hole 32*a* into which the head 27*a* of the third screw member 27 is inserted; and the small-diameter hole 32*b* into which the neck 27*b* of the third screw member 27 is inserted. Thus, when the third screw member 27 is screwed from the first screw insertion hole 32 of the attachment protrusion 30 on the front surface side into the third screw hole 28*a* of the fixing protrusion 28, the head 27*a* and the neck 27*b* of the third screw member 27 can be reliably inserted into the first screw insertion hole 32 of the attachment protrusion 30 on the front surface side. As a result, the attachment protrusion 30 on the front surface side can be reliably and firmly fixed to the fixing protrusion 28, and the protective buffer member 16 can be reliably and satisfactorily pressed against the outer surface of the case body 10.

In addition, the second screw insertion hole 31*a* of the attachment protrusion 31 on the back surface side is formed to have the smaller diameter than the inner diameter of the third screw hole 28*a* of the fixing protrusion 28. Thus, when the third screw member 27 is screwed from the first screw insertion hole 32 of the attachment protrusion 30 on the front surface side into the third screw hole 28*a* of the fixing protrusion 28, the non-threaded portion 27*d* of the third screw member 27 can be reliably and satisfactorily inserted into the second screw insertion hole 31*a* of the attachment protrusion 31 on the back surface side through the third screw hole 28*a* of the fixing protrusion 28. As a result, the attachment protrusion 31 on the back surface side can be securely fastened to the fixing protrusion 28, and the protective buffer member 16 can be reliably and satisfactorily pressed against the outer surface of the case body 10.

In addition, in the switch device 4, the protective buffer member 16 is made of the synthetic resin having elasticity, and includes the first and third storages 20 and 22 that have the bottoms 20*a* and 22*a* facing the inner end surfaces of the operation heads 18 and store the operation heads 18. Thus, the operation heads 18 can be reliably and satisfactorily protected by the first and third storages 20 and 22 of the protective buffer member 16. Further, even when the protective buffer member 16 is made of the synthetic resin having elasticity, it is possible to reliably prevent the protective buffer member 16 from being turned up with respect to the case body 10 by fastening the fitting attachment portion 26 by the third screw member 27.

That is, since the protective buffer member 16 is made of the synthetic resin having elasticity, when each of the operation heads 18 stored in the first and third storages 20 and 22 receives the impact from the outside of the case body 10, the operation heads 18 can be made to abut on the bottoms 20*a* and 22*a* of the first and third storages 20 and 22. Thus, the external impact can be buffered by the elasticity of each of the bottoms 20*a* and 22*a* and, as a result, the impact received from the outside by each of the operation heads 18 is prevented from being transmitted to the case body 10.

Therefore, in the switch device 4, it is possible to prevent each of the operation members 15 from being damaged by the external impact, and the impact generated when each of the operation heads 18 abuts on each of the bottoms 20*a* and 22*a* of the first and third storages 20 and 22 is not transmitted to the case body 10. Thus, it is possible to prevent breakages of the timepiece module 9 in the case body 10 and parts mounted on the timepiece module 9, and as a result, the impact resistance can be improved.

In addition, in the switch device 4, the bottoms 20*a* and 22*a* of the first and third storages 20 and 22, among the first to third storages 20 to 22 of the protective buffer member 16, are attached to the outer surface of the case body 10 by the second screw members 23, which are fastening members. Thus, the protective buffer member 16 can be easily and reliably attached to the case body 10.

That is, in the switch device 4 has a structure in which the screw attachment holes 24, into which the second screw members 23 are inserted, are provided in both of the bottoms 20*a* and 22*a* of the first and third storages 20 and 22, and the second screw holes 25 corresponding to the screw attachment holes 24 on the same axis are provided in the case body 10. Thus, the protective buffer member 16 can be easily and reliably attached to the case body 10 simply by inserting the second screw members 23 into the screw attachment holes 24 of the bottoms 20*a* and 22*a* of the first and third storages 20 and 22 and screwing the second screw members 23 into the second screw holes 25 of the case body 10.

In this case, in the switch device 4, each of the heads of the second screw members 23 is disposed in the large-diameter hole 24*a* of the screw attachment hole 24 and presses the small-diameter hole 24*b* of the screw attachment hole 24. Thus, when the protective buffer member 16 is attached to the case body 10, it is possible to reliably prevent the edges of the protective buffer member 16 located on each end side of the first and third storages 20 and 22 of the protective buffer member 16, that is, on the 5 o'clock side and the 1 o'clock side from being turned up.

That is, the second screw hole 25 on the 4 o'clock side with respect to the first storage 20 is located obliquely downward from the through-hole 10*b* on the 4 o'clock side of the case body 10 toward the 5 o'clock side and, thus, the end on the 5 o'clock side of the bottom 20*a* of the first storage 20 can be fixed to the case body 10 when attached to the outer surface of the case body 10 by the second screw member 23.

Therefore, when an external force, such as an impact, is applied from the outer circumferential direction of the case body 10 to the protective buffer member 16 on the 5 o'clock side in the first storage 20 on the 4 o'clock side, the edge of the end on the 5 o'clock side of the protective buffer member 16 can be prevented from being turned up with respect to the case body 10 by the external force.

In addition, the second screw hole 25 on the 2 o'clock side with respect to the third storage 22 is located obliquely upward from the through-hole 10*b* on the 2 o'clock side of the case body 10 toward the 1 o'clock side, and thus, the end on the 1 o'clock side of the bottom 22*a* of the third storage 22 can be fixed to the case body 10 when attached to the outer surface of the case body 10 by the second screw member 23.

Therefore, when an external force, such as an impact, is applied from the outer circumferential direction of the case body 10 to the protective buffer member 16 on the 1 o'clock side in the third storage 22 on the 2 o'clock side, the edge of the end on the 1 o'clock side of the protective buffer member 16 can be prevented from being turned up with respect to the case body 10 by the external force.

In this case, each of the screw attachment holes 24 provided in the bottoms 20*a* and 22*a* of the first and third storages 20 and 22 includes the large-diameter hole 24*a* in which the head of the second screw member 23 is disposed and the small-diameter hole 24*b* into which the threaded portion of the second screw member 23 is inserted. Thus, when each of the second screw members 23 is inserted into each of the screw attachment holes 24 and screwed into each of the second screw holes 25 of the case body 10, the head of each of the second screw members 23 can be disposed without protruding into each of the first and second storages 20 and 22.

Therefore, in the switch device 4, when the operation heads 18 abut on the bottoms 20*a* and 22*a* of the first and second storages 20 and 22 due to the external impact, the inner end surfaces of the operation heads 18 do not come into contact with the heads of the second screw members 23 and, thus, the bottoms 20*a* and 22*a* of the first and second storages 20 and 22 can satisfactorily buffer an impact when each of the operation heads 18 receives the impact.

Further, in the switch device 4, the three operation members 15 are provided from the 2 o'clock side to the 4 o'clock side along the outer circumference of the case body 10, and the protective buffer member 16 includes the first to third storages 20 to 22, each of which stores each of the operation heads 18 of the three operation members 15. Thus, the operation heads 18 of the three operation members 15 can be satisfactorily protected by the first to third storages 20 to 22 provided in the single protective buffer member 16. As a result, it is unnecessary to manufacture and individually attach the protective buffer member 16 for each of the first to third storages 20 to 22 and, thus, it is possible to reduce the number of parts and improve assembly workability.

In this case, in the switch device 4, the fitting attachment portions 26 are provided on both sides of the intermediate second storage 21 among the first to third storages 20 to 22 of the protective buffer member 16, that is, at two places between the first and second storages 20 and 21 and between the second and third storages 21 and 22, and the fitting attachment portions 26 are fastened by the third screw members 27 in the vertical direction which is the front and back surface direction of the case body 10.

Thus, the protective buffer member 16 can be reliably pressed against and attached to the case body 10 and, as a result, it is possible to reliably prevent the upper and lower edges of the protective buffer member 16 from being turned up.

That is, in the switch device 4, each of the two upper attachment protrusions 30 is attached to each of the two fixing protrusions 28 of the case body 10 by the head 27*a* and the neck 27*b* of the third screw member 27, and the upper side of the protective buffer member 16 is pressed against the outer surface of the case body 10. Thus, when an external force, such as an impact, is applied to the protective buffer member 16 from the vertical direction of the case body 10, the edge on the upper side of the protective buffer member 16 can be reliably prevented from being turned up due to the external force by each of the heads 27*a* and each of the necks 27*b* of the two third screw members 27.

In addition, in the switch device 4, each of the two lower attachment protrusions 31 is attached to each of the two fixing protrusions 28 of the case body 10 by the non-threaded portion 27*d* of the third screw member 27, and the lower side of the protective buffer member 16 is pressed against the outer surface of the case body 10. Thus, when an external force, such as an impact, is applied to the protective buffer member 16 from the vertical direction of the case body 10, the edge on the lower side of the protective buffer member 16 can be reliably prevented from being turned up due to the external force by each of the non-threaded portions 27*d* of the two third screw members 27.

Although the case where the protective buffer member 16 is made of the urethane resin has been described in the above-described embodiment, the present invention is not limited thereto, and any synthetic resin such as an elastomer may be used as long as the synthetic resin has elasticity and predetermined hardness.

In addition, the case where the protective buffer member 16 includes the first to third storages 20 to 22 has been described in the above-described embodiment, but the present invention is not limited thereto, and four or more storages may be provided, or may have a structure including two storages or one storage.

In addition, the case where the second storage 21 has no bottom has been described in the above-described embodiment, but the second storage may have a bottom similarly to the first storage 20 and the third storage 22.

In addition, the case where the third screw members 27 are inserted and attached from above the case body 10 when the fitting attachment portions 26 provided on the outer surface of the case body 10 and the inner surface of the protective buffer member 16 are fastened by the third screw members 27 has been described in the above-described embodiment, but the present invention is not limited thereto, and the third screw members 27 may be inserted and attached from below the case body 10.

In this case, it is sufficient to adopt a structure in which the second screw insertion hole 31*a* into which the non-threaded portion 27*d* of the third screw member 27 is inserted is provided in the upper attachment protrusion 30 of the protective buffer member 16 and the first screw insertion hole 32 into which the head 27*a* and the neck 27*b* of the third screw member 27 are inserted may be provided in the lower attachment protrusion 31.

Further, the case where the two fitting attachment portions 26 are provided on both side portions of the second storage 21 among the first to third storages 20 to 22 of the protective buffer member 16, that is, between the first and second storages 20 and 21 and between the second and third storages 21 and 22 has been described in the above-described embodiment. The present invention is not limited thereto, and it is sufficient to provide one fitting attachment portion 26 between two storages in a case where the two storages are provided.

In addition, the present invention is not limited thereto, and each of the fitting attachment portions 26 may be provided between the storages in a case where four or more storages are provided, or may be provided only between each of the storages located on both side portions and each of the storages adjacent thereto.

In addition, the above-described embodiment has been described regarding the case of being applied to the wristwatch, but the invention is not necessarily applied to the wristwatch, and can be applied to various timepieces, for example, a travel watch, an alarm clock, a table clock, a wall clock, and the like. In addition, the invention is not necessarily applied to the timepiece, and can be applied to electronic devices, for example, a mobile phone, a mobile information terminal, and the like.

Although an embodiment of the invention has been described as above, the invention is not limited thereto and includes aspects of the invention described in the claims and the equivalent range thereof.

What is claimed is:

1. A switch device comprising:

a case provided with a through-hole;

an operation member having an operation shaft inserted into the through-hole of the case, and an operation head provided at an outer end of the operation shaft; and a protective buffer member which has elasticity and is attached to an outer surface of the case, wherein:

the protective buffer member includes a storage which has a bottom facing an inner end surface of the operation head and which stores a periphery of the operation head, and the storage of the protective buffer member is formed such that one side of an outer peripheral end of the storage is at a substantially same height as an outer end surface of the operation head, and the other side of the outer peripheral end of the storage is provided with a notch so as to be lower than the outer end surface of the operation head.

2. The switch device according to claim 1, wherein the storage and the bottom are integrally formed.

3. The switch device according to claim 1, wherein the protective buffer member is made of a urethane resin having high hardness.

4. The switch device according to claim 1, wherein the protective buffer member is formed such that a thickness of the bottom is equal to or larger than a thickness of a side wall of the storage.

5. The switch device according to claim 3, wherein the protective buffer member is formed such that a thickness of the bottom is equal to or larger than a thickness of a side wall of the storage.

6. The switch device according to claim 1, wherein the bottom of the protective buffer member is attached to the outer surface of the case by a fastening member.

7. The switch device according to claim 1, wherein:

a plurality of the operation members are provided along an outer circumference of the case, and the protective buffer member is provided with a plurality of the storages, each of the plurality of storages storing the operation head of a respective one of the plurality of operation members.

8. The switch device according to claim 7, wherein among the plurality of storages, storages located at both ends of the protective buffer member are attached to the case by fastening members.

9. The switch device according to claim 1, wherein the protective buffer member is fitted to the outer surface of the case and fastened in a front-back surface direction of the case by a fastening member.

10. The switch device according to claim 9, wherein the operation member and the fastening member are disposed so as not to overlap each other on the outer surface of the case.

11. The switch device according to claim 9, further comprising:

fitting attachments provided on both the outer surface of the case and an inner surface of the protective buffer member facing the outer surface, wherein each of the fitting attachments includes a fixing protrusion provided on the outer surface of the case, a fitting recess which is provided on the inner surface of the protective buffer member and into which the fixing protrusion is fitted, and two attachment protrusions provided on the inner surface of the protective buffer member and facing front and back surface sides of the case in the fixing protrusion.

12. The switch device according to claim 11, wherein the fixing protrusion of the case is provided with a screw hole in the front-back surface direction of the case, the attachment protrusion of the protective buffer member located on the front surface side of the case is provided with a first screw insertion hole corresponding to the screw hole on an identical axis, and the attachment protrusion of the protective buffer member located on the back surface side of the case is provided with a second screw insertion hole corresponding to the screw hole on an identical axis.

13. The switch device according to claim 12, wherein the fastening member includes a head, a neck inserted into the first screw insertion hole of the attachment protrusion on the front surface side, a thread screwed into the screw hole of the fixing protrusion, and a non-thread having a diameter smaller than an outer diameter of the thread and inserted into the second screw insertion hole of the attachment protrusion on the back surface side.

14. The switch device according to claim 13, wherein:

the first screw insertion hole includes a large-diameter hole into which the head of the fastening member is inserted and a small-diameter hole into which the neck of the screw member is inserted, and the second screw insertion hole has a diameter smaller than an inner diameter of the screw hole of the fixing protrusion.

15. The switch device according to claim 9, wherein:

the protective buffer member is provided with a plurality of storages, each of the plurality of storages storing an operation head of a respective one of a plurality of operation members, and fitting attachments provided on both the outer surface of the case and an inner surface of the protective buffer member facing the outer surface are provided on both sides of an intermediate storage among the plurality of storages, and each of the fitting attachments is fastened in the front-back surface direction of the case by the fastening member.

16. A timepiece comprising the switch device according to claim 1.

17. A switch device comprising:

a case provided with a through-hole;

an operation member having an operation shaft inserted into the through-hole of the case, and an operation head provided at an outer end of the operation shaft; and a protective buffer member which has elasticity and is attached to an outer surface of the case, wherein:

the protective buffer member includes a storage which has a bottom facing an inner end surface of the operation head and which stores a periphery of the operation head, a plurality of the operation members are provided along an outer circumference of the case, and the protective buffer member is provided with a plurality of the storages, each of the plurality of storages storing the operation head of a respective one of the plurality of operation members.

18. The switch device according to claim 17, wherein the storage and the bottom are integrally formed.

19. The switch device according to claim 17, wherein the protective buffer member is made of a urethane resin having high hardness.

20. The switch device according to claim 17, wherein the protective buffer member is formed such that a thickness of the bottom is equal to or larger than a thickness of a side wall of the storage.

21. The switch device according to claim 17, wherein the bottom of the protective buffer member is attached to the outer surface of the case by a fastening member.

22. The switch device according to claim 17, wherein among the plurality of storages, storages located at both ends of the protective buffer member are attached to the case by fastening members.

23. The switch device according to claim 17, wherein the protective buffer member is fitted to the outer surface of the case and fastened in a front-back surface direction of the case by a fastening member.

24. The switch device according to claim 23, wherein the operation member and the fastening member are disposed so as not to overlap each other on the outer surface of the case.

25. The switch device according to claim 23, further comprising:

fitting attachments provided on both the outer surface of the case and an inner surface of the protective buffer member facing the outer surface, wherein each of the fitting attachments includes a fixing protrusion provided on the outer surface of the case, a fitting recess which is provided on the inner surface of the protective buffer member and into which the fixing protrusion is fitted, and two attachment protrusions provided on the inner surface of the protective buffer member and facing front and back surface sides of the case in the fixing protrusion.

26. The switch device according to claim 25, wherein the fixing protrusion of the case is provided with a screw hole in the front-back surface direction of the case, the attachment protrusion of the protective buffer member located on the front surface side of the case is provided with a first screw insertion hole corresponding to the screw hole on an identical axis, and the attachment protrusion of the protective buffer member located on the back surface side of the case is provided with a second screw insertion hole corresponding to the screw hole on an identical axis.

27. The switch device according to claim 26, wherein the fastening member includes a head, a neck inserted into the first screw insertion hole of the attachment protrusion on the front surface side, a thread screwed into the screw hole of the fixing protrusion, and a non-thread having a diameter smaller than an outer diameter of the thread and inserted into the second screw insertion hole of the attachment protrusion on the back surface side.

28. The switch device according to claim 27, wherein:

the first screw insertion hole includes a large-diameter hole into which the head of the fastening member is inserted and a small-diameter hole into which the neck of the screw member is inserted, and the second screw insertion hole has a diameter smaller than an inner diameter of the screw hole of the fixing protrusion.

29. The switch device according to claim 23, wherein:

the protective buffer member is provided with a plurality of storages, each of the plurality of storages storing an operation head of a respective one of a plurality of operation members, and fitting attachments provided on both the outer surface of the case and an inner surface of the protective buffer member facing the outer surface are provided on both sides of an intermediate storage among the plurality of storages, and each of the fitting attachments is fastened in the front-back surface direction of the case by the fastening member.

30. A timepiece comprising the switch device according to claim 17.

31. A switch device comprising:

a case provided with a through-hole;

an operation member having an operation shaft inserted into the through-hole of the case, and an operation head provided at an outer end of the operation shaft; and a protective buffer member which has elasticity and is attached to an outer surface of the case, wherein:

the protective buffer member includes a storage which has a bottom facing an inner end surface of the operation head and which stores a periphery of the operation head, and the protective buffer member is fitted to the outer surface of the case and fastened in a thickness direction of the case by a fastening member.

32. The switch device according to claim 31, wherein the storage and the bottom are integrally formed.

33. The switch device according to claim 31, wherein the protective buffer member is made of a urethane resin having high hardness.

34. The switch device according to claim 31, wherein the protective buffer member is formed such that a thickness of the bottom is equal to or larger than a thickness of a side wall of the storage.

35. The switch device according to claim 31, wherein the bottom of the protective buffer member is attached to the outer surface of the case by a fastening member.

36. The switch device according to claim 31, wherein the operation member and the fastening member are disposed so as not to overlap each other on the outer surface of the case.

37. The switch device according to claim 31, further comprising:

fitting attachments provided on both the outer surface of the case and an inner surface of the protective buffer member facing the outer surface, wherein each of the fitting attachments includes a fixing protrusion provided on the outer surface of the case, a fitting recess which is provided on the inner surface of the protective buffer member and into which the fixing protrusion is fitted, and two attachment protrusions provided on the inner surface of the protective buffer member and facing front and back surface sides of the case in the fixing protrusion.

38. The switch device according to claim 37, wherein the fixing protrusion of the case is provided with a screw hole in the thickness direction of the case, the attachment protrusion of the protective buffer member located on the front surface side of the case is provided with a first screw insertion hole corresponding to the screw hole on an identical axis, and the attachment protrusion of the protective buffer member located on the back surface side of the case is provided with a second screw insertion hole corresponding to the screw hole on an identical axis.

39. The switch device according to claim 38, wherein the fastening member includes a head, a neck inserted into the first screw insertion hole of the attachment protrusion on the front surface side, a thread screwed into the screw hole of the fixing protrusion, and a non-thread having a diameter smaller than an outer diameter of the thread and inserted into the second screw insertion hole of the attachment protrusion on the back surface side.

40. The switch device according to claim 39, wherein:

the first screw insertion hole includes a large-diameter hole into which the head of the fastening member is inserted and a small-diameter hole into which the neck of the screw member is inserted, and the second screw insertion hole has a diameter smaller than an inner diameter of the screw hole of the fixing protrusion.

41. The switch device according to claim 31, wherein:

the protective buffer member is provided with a plurality of storages, each of the plurality of storages storing an operation head of a respective one of a plurality of operation members, and fitting attachments provided on both the outer surface of the case and an inner surface of the protective buffer member facing the outer surface are provided on both sides of an intermediate storage among the plurality of storages, and each of the fitting attachments is fastened in the thickness direction of the case by the fastening member.

42. A timepiece comprising the switch device according to claim 1.

* * * * *